US011542710B2

(12) United States Patent
Patki et al.

(10) Patent No.: US 11,542,710 B2
(45) Date of Patent: Jan. 3, 2023

(54) ROOF TILE AND A ROOF COVERING

(71) Applicant: Dal-Tile Corporation, Dallas, TX (US)

(72) Inventors: Rahul Patki, Richardson, TX (US); Claudio Caselli, Dallas, TX (US)

(73) Assignee: Dal-Tile Corporation, Dallas, TX (US)

( * ) Notice: Subject to any disclaimer, the term of this patent is extended or adjusted under 35 U.S.C. 154(b) by 0 days.

(21) Appl. No.: 17/471,238

(22) Filed: Sep. 10, 2021

(65) Prior Publication Data

US 2022/0251840 A1 Aug. 11, 2022

Related U.S. Application Data

(63) Continuation-in-part of application No. 17/171,245, filed on Feb. 9, 2021.

(51) Int. Cl.

| | |
|---|---|
| ***E04D 1/28*** | (2006.01) |
| ***E04D 1/04*** | (2006.01) |
| ***E04D 1/34*** | (2006.01) |

(52) U.S. Cl.

CPC ..... *E04D 1/28* (2013.01); *E04D 1/04* (2013.01); *E04D 1/34* (2013.01); *E04D 2001/3458* (2013.01); *E04D 2001/3473* (2013.01)

(58) Field of Classification Search

CPC ..... E04D 3/04; E04D 2001/3458; E04D 2001/3473; E04D 2001/3432; E04D 2001/3435; E04D 2001/3461; E04D 2001/3467; E04D 2001/3494; E04D 1/04; E04D 1/34; E04D 1/12; E04D 1/16; E04D 1/28; E04D 1/29; E04D 1/2914; E04D 1/2916; E04D 1/2921; E04D 1/2935

See application file for complete search history.

(56) References Cited

U.S. PATENT DOCUMENTS

| | | | | |
|---|---|---|---|---|
| 1,549,723 A | | 8/1925 | Mattison | |
| 1,828,222 A | * | 10/1931 | Clow | E04D 1/2916 52/525 |
| 2,482,835 A | * | 9/1949 | Bremer | E04D 1/2916 52/553 |

(Continued)

FOREIGN PATENT DOCUMENTS

| | | |
|---|---|---|
| CN | 2173688 Y | 8/1994 |
| CN | 204401887 U | 6/2017 |

(Continued)

OTHER PUBLICATIONS

ASTM C373-88 (Reapproved 2006); Standard Test Method for Water Absorption, Bulk Density, Apparent Porosity, and Apparent Specific Gravity of Fired Whiteware Products, Feb. 2006, 2 pages.

(Continued)

*Primary Examiner* — Jessica L Laux

(74) *Attorney, Agent, or Firm* — Troutman Pepper Hamilton Sanders LLP; James E. Schutz; Chris N. Davis

(57) ABSTRACT

A roof tile comprising a decorative layer, having at least a ceramic body, and a support layer disposed below the decorative layer, wherein the roof tile comprises an upper edge, a lower edge which is opposite to the upper edge and two opposite side edges, said side edges being transversal to the upper edge, wherein said roof tile comprises at least one anchoring element for anchoring the roof tile to a structure or framework.

18 Claims, 8 Drawing Sheets

(56) References Cited

U.S. PATENT DOCUMENTS

| | | | | |
|---|---|---|---|---|
| 2,730,969 | A | 1/1956 | Perry | |
| 3,796,618 | A | 3/1974 | Lehming et al. | |
| 4,092,092 | A | 5/1978 | Dye et al. | |
| 4,341,336 | A | 7/1982 | Smith | |
| 4,787,190 | A | 11/1988 | Papsdorf | |
| 5,362,342 | A | 11/1994 | Murray et al. | |
| 5,533,313 | A * | 7/1996 | Pike | E04D 1/34 52/712 |
| 5,671,577 | A | 9/1997 | Todd | |
| 5,935,885 | A | 8/1999 | Hnat et al. | |
| 6,052,961 | A * | 4/2000 | Gibbs | E04D 1/365 52/518 |
| 6,248,271 | B1 | 6/2001 | Graham et al. | |
| 7,596,919 | B1 | 10/2009 | Vande Hey et al. | |
| 7,736,557 | B2 | 6/2010 | Evans et al. | |
| 8,371,072 | B1 | 2/2013 | Shanes et al. | |
| 8,507,098 | B2 | 8/2013 | Long et al. | |
| 8,898,963 | B1 * | 12/2014 | Amatruda | E04D 1/2963 52/409 |
| 10,618,156 | B2 | 4/2020 | Rodriguez et al. | |
| 2004/0128929 | A1 | 7/2004 | Moen | |
| 2004/0139822 | A1 | 7/2004 | Gehring et al. | |
| 2005/0284339 | A1 | 12/2005 | Brunton et al. | |
| 2007/0215668 | A1 | 9/2007 | Tabacco et al. | |
| 2008/0078132 | A1 | 4/2008 | Jolitz | |
| 2008/0110123 | A1 | 5/2008 | Oberoi et al. | |
| 2008/0277446 | A1 | 11/2008 | Yamamoto et al. | |
| 2008/0302050 | A1 | 12/2008 | Kalkanoglu | |
| 2009/0255202 | A1 | 10/2009 | Heidennann | |
| 2010/0032086 | A1 | 2/2010 | Hwang | |
| 2010/0077689 | A1 | 4/2010 | Kalkanoglu et al. | |
| 2011/0072755 | A1 | 3/2011 | Wakefield | |
| 2012/0085053 | A1 | 4/2012 | Barone | |
| 2012/0148806 | A1 | 6/2012 | Dubey et al. | |
| 2013/0031864 | A1 | 2/2013 | Schools et al. | |
| 2016/0231024 | A1 | 8/2016 | Cornelissen | |
| 2016/0319554 | A1 | 11/2016 | Thiers et al. | |
| 2017/0218632 | A1 | 8/2017 | Patki et al. | |
| 2018/0038108 | A1 * | 2/2018 | Aschenbeck | E04D 1/29 |
| 2018/0290421 | A1 | 10/2018 | Ide | |
| 2019/0305718 | A1 | 10/2019 | Peng et al. | |
| 2019/0319577 | A1 | 10/2019 | Hu et al. | |

FOREIGN PATENT DOCUMENTS

| | | | |
|---|---|---|---|
| DE | 3121111 | A1 | 9/1982 |
| DE | 4411458 | A1 | 3/1995 |
| DE | 29619183 | U1 | 12/1996 |
| DE | 102010019815 | A1 | 10/2011 |
| EP | 0117391 | B1 | 4/1987 |
| EP | 1621309 | A2 | 2/2006 |
| EP | 2172600 | A1 | 4/2010 |
| GB | 2456008 | A | 7/2009 |
| JP | 2713909 | B2 | 2/1998 |
| JP | H10-194819 | A | 7/1998 |
| JP | 2000-6125 | A | 1/2000 |
| JP | 2003193630 | A | 7/2003 |
| JP | 09194250 | A | 7/2007 |
| WO | 200136882 | A1 | 5/2001 |
| WO | 2011/107835 | A1 | 9/2011 |
| WO | 2013158594 | A1 | 10/2013 |
| WO | 2015034366 | A2 | 3/2015 |
| WO | 2015092745 | A1 | 6/2015 |

OTHER PUBLICATIONS

"Builders' Show: Boral's Hail-Resistant Concrete Rool Tiles," Consumer Reports News, Jan. 24, 2013 [retrieved Jun. 26, 2017]; retreived from the Internet <URL:http://www.boralamerica.com/roofing/about/news/hail-resistant-roof-tiles>, 12 pages.

Griese, B., "Is it Really Porcelain," Feb. 2008 [retrieved Jun. 26, 2017]; retrieved from the Internet <URL:http://www.tcnatile.com/images/pdfs/ls%20_%20Really%20Porcelain.pdf>, 2 pages.

International Search Report and Written Opinion for Related International Application No. PCT/US2017/015217 dated Jun. 16, 2017, 10 pages.

"Vivaldi," Lea Ceramiche, Jan. 13 [retrieved Jun. 26, 2017]; retrieved from the Internet <URL:http://www.readingrock.com/sites/default/files/Vivaldi_lux.pdf>, 32 pages.

International Search Report and Written Opinion for International (PCT) Application No. PCT/US2019/039201 dated Sep. 13, 2019.

International Search Report and Written Opinion for International (PCT) Application No. PCT/US2019/045455 dated Nov. 13, 2019.

International Search Report and Written Opinion for International (PCT) Application No. PCT/US2019/040218 dated Oct. 1, 2019.

International Search Report and Written Opinion for International (PCT) Application No. PCT/US2021/017170 dated Apr. 28, 2021.

International Search Report and Written Opinion for PCT Application No. PCT/US2022/015571 dated May 6, 2022.

* cited by examiner

ROOF TILE AND A ROOF COVERING

CROSS-REFERENCE TO RELATED APPLICATIONS

This application claims priority to U.S. patent application Ser. No. 17/171,245, filed on 9 Feb. 2021, the disclosure of which is herein incorporated by reference in its entirety.

BACKGROUND

The invention further relates to a ceramic roof tile, e.g., a roof tile comprising a ceramic body, preferably made of porcelain, and to a roof covering comprising porcelain roof tiles.

US 2017/0218632, U.S. Pat. No. 10,618,156 and U.S. Ser. No. 16/100,900 disclose roof tiles having a body made of porcelain. Such kind of materials improve the weather/frost resistance and durability of the roof tile with respect to other kinds of ceramic materials like red body ceramic, for example terracotta.

In order to improve waterproofness of the roof covering, said roof tile are installed above a polymeric underlayment that is disposes below each row of roof tiles in the roof covering. In practice, said row of the roof covering comprises one strip of underlayment below multiple tiles so to impermeabilize the joint between roof tiles on the same row. Anyway, the placement and securing of said underlayment provides is a time-consuming operation that slows down the roof covering installation operation.

The present invention aims in the first place at an alternative roof tile, of the aforementioned type, whereby, according to various preferred embodiments, solutions are offered for problems with roof tiles known in the art.

BRIEF SUMMARY OF THE INVENTION

In one aspect, the invention is directed to a roof tile comprising a decorative layer, having at least a ceramic body, and a support layer disposed below the decorative layer, wherein the roof tile comprises an upper edge; a lower edge which is opposite to the upper edge; and two opposite side edges, the side edges being transversal to the upper edge, wherein the roof tile comprises at least one anchoring element for anchoring the roof tile to a structure or framework.

In another aspect, the present invention is directed to a roof tile that comprises:

(i) a decorative layer, having at least a ceramic body, and a support layer disposed below the decorative layer, wherein the roof tile comprises an upper edge, a lower edge which is opposite to the upper edge and two opposite side edges, said side edges being transversal to the upper edge;

(ii) a first coupling element configured for being coupled to an adjacent roof tile in a roof covering and wherein said first coupling element is provided at least at one side edge of the roof tile, preferably said first coupling element can be in form of an adhesive strip; and (iii) an anchoring element for anchoring the roof tile to a structure or framework, preferably said anchoring element can be disposed in a position that is proximal to said first coupling element, more preferably said coupling element being disposed between a side edge of the decorative layer and the anchoring element.

These and other objects, features and advantages of the present invention will become more apparent upon reading the following specification in conjunction with the accompanying description, claims and drawings.

BRIEF DESCRIPTION OF THE DRAWINGS

The accompanying Figures, which are incorporated in and constitute a part of this specification, illustrate several aspects described below.

DETAILED DESCRIPTION OF THE INVENTION

Figure 1:
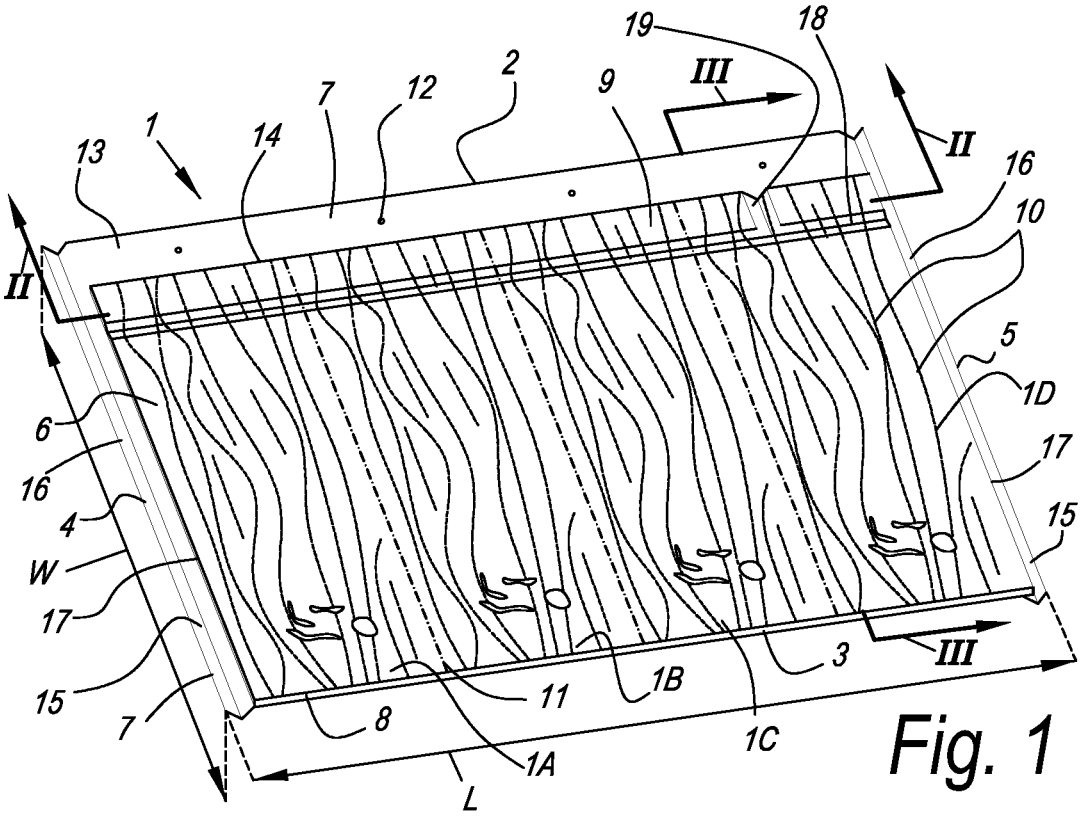
FIG. 1 represents a perspective view of a roof tile in a first preferred embodiment, with a view on the front face of the roof tile.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named. In other words, the terms "a," "an," and "the" do not denote a limitation of quantity, but rather denote the presence of "at least one" of the referenced item.

As used herein, the term "and/or" may mean "and," it may mean "or," it may mean "exclusive-or," it may mean "one," it may mean "some, but not all," it may mean "neither," and/or it may mean "both." The term "or" is intended to mean an inclusive "or."

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose. It is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Thereto, the present invention, according to a first independent aspect, relates to a roof tile comprising a decorative layer, the decorative layer having at least a ceramic body; and a support layer disposed below the decorative layer, wherein the roof tile comprises an upper edge, a lower edge which is opposite to the upper edge, and two opposite side edges, the side edges being transversal to the upper edge, wherein the roof tile comprises at least one first coupling element configured for being coupled to an adjacent roof tile in a roof covering and wherein said first coupling element is provided at least at one side edge of the roof tile. Preferably said roof tile comprises first coupling elements provided at opposite side edges. Since the first coupling elements are provided at side edges of the roof tile, they are intended for coupling roof tiles on the same row of roof tiles in the roof covering to each other. In this way, the joint between multiple tiles on the same row in the roof covering can be reduced or deleted, thereby improving the waterproofness of the roof covering. Moreover, said impermeabilization is obtained during the installation of the roof tile without the need of any previous operation, thereby improving the speed of the roof covering installation. As another advantage, easy installation is obtained, since the coupling elements may hold the roof tile in place for attaching or fastening it to the framework of the roof. Other advantages that may be obtained include improved walking resistance, improved uplift wind resistance and/or improved thermal insulation. By installing the roof tile to the supporting structure of the roof solely with nails can cause leveling defects between roof tiles of the same row. This leveling issue can cause aesthetic defects in the roof covering and even expose the roof tiles to wind lift-up. The described coupling between roof tiles causes the roof tiles to be properly leveled relative to each other.

As used herein, the term "upper edge" refers the edge that in use is directed to be disposed in an upper position compared to the other edges. Said upper row is intended to be disposed substantially horizontally in the roof covering. The term "row of roof tiles in the roof covering" refers to a succession of roof tiles that are placed one beside the other along a substantially horizontal line.

Preferably, the first coupling elements can be partially or completely formed in the support layer. If said coupling elements are destined to forming a mechanical coupling, it may be possible to manufacture and shape said coupling elements in a material that is tougher and/or more elastic, or in general showing properties that are more suitable for forming the coupling element than the ceramic material of the body. The manufacturing of the roof tile may also therefore be simplified.

The upper and lower edges as well as the opposite side edges of the roof tile may be provided with coupling elements. In a preferred embodiment, the roof tile can comprise at least one second coupling element and/or at least one third coupling element. Said second coupling element and/or at least one third coupling element may be, preferably, adapted to couple an adjacent roof tile on a different row in a roof covering, more preferably an overlapping or overlapped roof tile. In particular, said second coupling element is configured for being coupled with a third coupling element of an adjacent roof tile. Preferably, said second and third coupling elements are disposed close to, and preferably parallel to, the lower and the upper edges of the roof tile respectively. Said second and third coupling elements can provide for a simplified installation of the roof tile since they can provide for an immediate and precise overlapping between tiles belonging to different rows in the roof covering and can help maintain this position before fixing the roof tile to the roof structure.

In a preferred embodiment, said second coupling element can be at least partially provided in, or more preferably formed in, the decorative layer, for example in the upper surface of the decorative layer. More preferably, said second coupling can be made in the ceramic body. Thus, the second coupling element can provide for a very precise overlapping between roof tiles of different rows in the roof covering. For example, said coupling element can be in the form of a groove realized in the decorative layer.

Said second coupling element can be provided at a predetermined distance from the upper edge, of the roof tile, preferably of the decorative layer. The predetermined distance can be selected in order to minimize or maximize the overlapping the between the roof tiles. Large overlapping can result in higher wind uplift resistance and better impermeability of the roof covering, whereas reduced overlapping can result in a lower weight of the roof covering and a reduced number of roof tiles, thereby reducing the cost of the roof covering and speeding up the installation. Due to the coupling, the wind uplift can be reduced and impermeability can be improved, as well as minimizing the overlapping. Preferably, said predetermined distance is less than one half, more preferably less than one third, for example equal or less than 26% of the width of the roof tile, wherein the width is defined as the dimension in a direction parallel to the side edge.

It is also possible that the roof tile comprises a further second coupling element that is substantially parallel to the side edges. In this case, said further second coupling element is configured for being coupled with one of the first coupling element of an overlapping roof tile. This is preferably the case when the overlapping tiles, i.e., tiles belonging to different rows in the roof covering, are disposed offset to each other. Thus, a precise offset positioning of overlapping tiles can be achieved together with an improved impermeability. Preferably, the further second coupling element runs along a limited portion of the width of the tile, for example it runs substantially from the second coupling element to the upper edge of the decorative layer.

Said third coupling element can be provided close to, and preferably parallel to, the lower edge of the roof tile. The third coupling element can be adapted for coupling with an overlapped roof tile, i.e., with a roof tile on a different row in the roof covering that is disposed partially below the roof tile. In a preferred embodiment, the third coupling element is disposed substantially in correspondence of said lower edge. Thus, the coupling of the third coupling element with the second coupling element of an adjacent tile can provide for an extremely precise positioning of overlapping roof tile. Moreover, said coupling can further limit open interspaces between overlapping roof tiles thereby improving impermeability. In a preferred embodiment, said third coupling element can be at least partially, preferably completely disposed below said decorative layer, in such a way to be hidden from external view once coupled.

In an embodiment, at least one of the opposite side edges of the support layer may extend beyond the ceramic body, for example in such a way that its associated coupling element is situated, partially or completely, beyond the ceramic body. In a preferred embodiment, both the side edges of the support layer can extend, partially or completely, beyond the ceramic body for example in such a way that their associated coupling elements are situated, partially or completely, beyond the ceramic body. Thus, during installation, coupling can be simplified since the coupling elements are at least partially visible and not hidden by the ceramic body. In a most preferred embodiment, at least one of said coupling elements extend only partially beyond the edge of the decorative layer. In this way in a coupled condition, the decorative layers can be closer to each other, thereby reducing a gap between said decorative layers and improving waterproofness of the roof covering.

The roof tile can be such that in a coupled configuration of two roof tiles in the same row, an interspace is established at least between the decorative layers, preferably such that the decorative layers are placed at a determined distance each other. In this case, it is preferable that said determined distance between the decorative layer is less than 5 mm, more preferably less than 3 mm so as to not be visible from the outside. The determined distance is a consequence of the configuration of the coupling element.

The aforementioned coupling elements may be performed according to one or more of the following possibilities, inasmuch these are not contradictory:

- the coupling elements are provided with a locking system, which, in the coupled condition of two of such roof tiles, is only active in a direction parallel to the plane of the roof covering, preferably perpendicular to the coupled edges, which means that the moving apart of two of such coupled roof tiles in said direction is limited and possibly prevented. In an example, the coupling elements comprise hook-shaped parts.
- the coupling elements are provided with a locking system, which, in the coupled condition of two of such roof tiles, is only active in the direction perpendicular to the plane of the roof covering, which means that the mutual moving apart of two of such coupled roof tiles in said direction is limited and possibly prevented. In an example, the coupling elements comprise a tongue and groove coupling.
- the coupling elements are provided with a locking system, which, in the coupled condition of two of such roof tiles, is active in the direction parallel to the plane of the roof covering and perpendicular to the coupled edges as well as in the direction perpendicular to the plane of the roof covering, which means that the moving apart of two of such coupled roof tiles in said directions is limited and possibly prevented;
- the coupling elements are free from locking systems. In an example, these coupling elements define an overlap between the respective layers of two of such coupled roof tiles.
- the coupling elements provide for a click-type or snap-type coupling;
- the coupling elements are configured such that they allow the coupling two of such roof tiles by means of a downward movement of one roof tile with respect to the other, wherein the term "downward" refers to a movement in a direction that is substantially perpendicular to the plane of the roof covering;
- the coupling elements are configured such that they allow the coupling two of such roof tiles by means of a sliding movement of one roof tile with respect to the other along a direction that is substantially parallel to the plane of the roof covering, such as coupling parts of a dove-tail or tongue and groove type;
- the coupling elements can comprise adhesive adapted to fix a portion of an adjacent roof tile so that moving apart of two of such coupled roof tiles in a direction that is parallel and/or perpendicular to the plane of the roof covering is limited and possibly prevented; in this case the adhesive can be provided in form of a pressure sensitive adhesive; the adhesive strip can be covered by a peelable sheet that is peeled off just before installation of the tile.

In a first preferred embodiment, the coupling elements are provided with a locking system, which, in the coupled condition of two of such roof tiles, is only active in the direction parallel to the plane of the roof covering and perpendicular to the coupled edges, which means that the mutual moving apart of two of such coupled roof tiles in said direction is limited and possibly prevented, and wherein the coupling elements are configured such that they allow the coupling two of such roof tiles by means of a downward movement of one roof tile with respect to the other. In particular at least one of said coupling elements can be, for example, upwardly concave shaped, for example in the form of an upward V-notch, or an upward hook shape, and being adapted to receive at least a portion of the coupling element of the adjacent tile by a downward movement. In this way, when they are coupled, locking surfaces are formed between the coupling elements that limit or prevent mutual moving apart of two of such coupled roof tiles in a direction parallel to the plane of the roof covering.

In a first preferred embodiment, the coupling elements on opposite sides of the roof tile can have a similar shape, preferably they both have an upward concave shape, for example in form of an upward V-notch. This shape is relatively simple to manufacture and provides for a sufficient locking. Moreover, especially in case of the V-notch shape, the coupling elements can be very easily coupled, since the inclined wall of the concave part can help insertion of one coupling element into the other.

In a most preferred configuration of the first preferred embodiment, the coupling elements on opposite sides of the roof tile can be slightly different, especially in dimension, to simplify coupling. For example, one of the two opposite coupling elements can have a deeper concavity than the other. Moreover, at least one of said coupling element can extend only partially beyond the edge of the decorative layer, so that the said decorative layer partially overlaps the upward concave shape. In this way in a coupled condition, the decorative layers can be closer to each other, thereby reducing a gap between said decorative layers and improving waterproofness of the roof covering. It is also possible that the portion of the lower surface of the decorative layer that partially overlaps the coupling element, in the coupling condition, can form a locking surface that can limit or prevent a mutual movement of the roof tile in a direction that is perpendicular to the plane of the roof covering.

In a second preferred embodiment, the coupling elements are in form of an adhesive strip. Said adhesive is adapted to fix a portion, preferably a portion of a lower surface, of an adjacent roof tile. In this case the coupling element of one roof tile does not have to necessarily cooperate with a coupling element of another roof tile. For example and not limitation, the adhesive can be a thermosetting adhesive or a thermoplastic adhesive. In a preferred embodiment, said adhesive can be a pressure sensitive adhesive, e.g., natural rubber PSA, synthetic rubber PSA, acrylic PSA, silicone PSA, blends of different polymers etc. In a preferred embodiment, the adhesive is synthetic rubber-based PSA. Preferably, the adhesive can be covered by a peelable sheet or lining that is adapted to be peeled off at the time of installation. For example, the adhesive can be a low tack adhesive to allow easy removal or substitution of a roof tile. For example, the adhesive can have a tensile strength less than 1000 N/m, preferably less than 700 N/m, even more preferably less than 30 N/m, for example comprised between 80 N/m and 270 N/m. Said adhesive may be preferably directed upward, for example it can be provided on an upper surface of the roof tile, in particular on an upper surface of the support layer and/or of the decorative layer. This can be especially the case when the first coupling element and/or the second coupling element are in the form of an adhesive strip. In some embodiments, said adhesive strip may be directed downward, for example it can be provided on a lower surface of the roof tile, in particular a lower surface of the support layer and/or of the decorative layer. This can be especially the case when the first coupling element and/or the third coupling element are in the form of an adhesive strip.

In this second embodiment, the extending portions of the support layer provided with the adhesive strip can be substantially flat.

Preferably, said coupling elements can run, continuously or discontinuously, substantially along the whole edge of the roof tile. In this way, relative positioning of the coupling elements and installation of the roof tile can further be simplified, and a water-tight seal obtained between adjacent tiles.

In case of coupling elements being present at the upper and lower edges as well as at the opposite side edges of the support layer situated below the ceramic body, the coupling elements at the upper and lower edges may be of a different type than the coupling parts at the side edges. However, in a preferred case, the coupling elements on opposite sides may show substantially the same shape and dimension, more preferably they can be slightly different, especially in dimension, to simplify coupling. For example, coupling elements on opposite sides that are in the form of upward concave shapes can have one shape slightly smaller than the other for being easily coupled together.

In some embodiments, the roof tile can comprise the coupling elements adapted to form a mechanical coupling as well as coupling element provided with an adhesive strip, e.g., the first coupling element can be configured for mechanical coupling and the second or third coupling element can be in the form of an adhesive strip. It is also possible that in some embodiments the coupling elements are provided by a combination of mechanical coupling and adhesive strip. For example, the coupling elements can be in form of an upward concave shape, wherein an adhesive strip is provided on surface of the upward concave shape.

In a preferred embodiment, the support layer comprises a portion extending beyond the upper edge of the decorative layer. Said extending portion can provide a tough portion of the roof tile that can be nailed or screwed to the roof structure so as not to cause breakage of the ceramic body. In a preferred embodiment said extending portion is free from any attachment hole and during installation the nail or screw is forced through the support layer. In this case, as discussed further below, the support layer is made of a material and/or has a thickness that can be easily perforated by the nail or screw. Moreover, by attaching the nail in the support layer it is also possible to reduce the overlapping between the ceramic bodies of roof tile, thereby reducing the load in the roof structure.

According to a preferred embodiment, said upper edge corresponds to the length, i.e., the longest edge of the roof tile. The inventors have found that by attaching the roof tile to the roof structure close to the longest edge, the roof covering may be composed of a relatively small amount of roof tiles, thereby minimizing the number of joints present in the roof covering, in particular between roof tiles in the same row, and consequently lowering the risk of water penetration.

In an alternative embodiment the roof tile can be provided with at least one attachment hole. Such attachment hole is used to attach or fasten the roof tile to a roof structure or framework of the roof, said framework for instance being formed by battens. The attachment hole may be preferably a through hole. The attachment hole can enable a safe and secure installation of the roof tile, for example by using nails, screws or wires. Moreover, the attachment hole can enable a simple and efficient way to install the roof tile.

The attachment hole can be situated closer to the upper edge of the roof tile than to the lower edge of the roof tile. Preferably, the attachment hole can be situated at a distance from the upper edge of the roof tile, as measured in the width direction of the roof tile, which is less than 0.25 times the width of the roof tile. Advantageously, the extent of overlap between adjacent roof tiles in subsequent rows of the roof covering may be minimized.

In this alternative embodiment, the roof tile can be provided with a multiplicity of attachment holes, for example more than 2, preferably less than 6. The inventors have found that three attachment holes provide for a good balance between the desired wind lift up resistance and speed of installation. The attachment holes of said plurality can be aligned parallel to the upper edge of the roof tile.

If the roof tile comprises attachment holes, it is preferable that they are provided in the portion of the support layer that extends beyond an upper edge of the ceramic body. This placement can reduce the risk of breaking the tile during installation with nails and/or screws.

In a special embodiment, the roof tile can comprise an anchoring element for the anchorage of the roof tile to the structure or framework of the roof. Said anchorage element can comprise one or more attachment holes or can be suitable for being perforated so that the attachment hole is created during the installation. The anchoring element is adapted to provide a fixing of the roof tile in a position that is distanced from the upper edge so to help keeping the lower edge of the roof tile as closer as possible to the structure or framework. In this way it is possible to reduce the risk of wind lift-up and of tilting of the roof tile around its upper edge. Due to the anchoring element that keeps down the roof tile, it may be possible to significantly improve the waterproofness of the roof covering. In fact, the inventors have surprisingly found that with the addition of the anchorage element the waterproofness can be enhanced at such a level that it can justify the absence of any underlayment below the roof tiles, thereby also speeding up the installation of the roof covering.

In a preferred configuration of said special embodiment, the anchoring element can be in form of a tilting arm that can tilt around one of its ends in order to adjust its inclination with respect the plane of the roof tiles. In this way the anchoring element can be tilted to adjust its position on the structure or framework so as to allow the anchoring of roof tiles having different inclinations. In fact, it is to be noted that the roof tiles are normally installed with overlap in the roof covering so that each roof tile will stay in the roof covering with an inclination that differs from that of the roof structure or framework. Preferably, said anchoring element is positioned closer to the lower edge of the roof tile than to the upper edge thereof. In a preferred configuration of said special embodiment, said anchoring element can be disposed at a side edge of the roof tile, such that the anchoring element can be easily accessible by the operator and can be hidden by an adjacent roof tile after the installation.

In a preferred configuration of said special embodiment, the anchoring element can be provided in or on the support layer. Preferably, said anchoring element can be disposed close to the coupling element, in particular the first coupling element. In particular, in a preferred configuration the anchoring element can be disposed in such a way that the coupling element, preferably the first coupling element, can be disposed in or on the support layer in such a way that the coupling element is disposed between the edge of the decorative layer and the anchoring element. The inventors have surprisingly found that this disposition may lead to an improved synergy between the coupling element and the anchoring element for achieving a higher waterproofness of the floor covering. In fact, in this way the coupling element is closer to the edge of the decorative layer so to avoid infiltration of the water and the anchoring element keeps the roof tile in position so that the coupling at the coupling elements is tighter and more precise and its waterproof effect is further improved.

In an alternative embodiment, the attachment hole may be present at least in the ceramic body of the roof tile. When using nails or screws, pressure is often exerted onto the ceramic body for attaching it to the roof framework. Due to the ceramic body being made of porcelain, the risk of any damage or breakage of the roof tile resulting from that pressure may be reduced. Thus, the attachment hole can comprise a first portion in the ceramic body and a second portion in the support layer.

In another alternative embodiment, said support layer may be offset with respect to the decorative layer in the length direction of the roof tile and/or in the width direction of the roof tile. In this further alternative embodiment, the support layer comprises portions that extend beyond one side edge and/or beyond the upper edge (or the lower edge) of the decorative layer, whereas the decorative layer comprises portions that extend beyond the opposite side edge and/or beyond the lower edge (or the upper edge) of the support layer. In the coupled condition the extending portion of the decorative layer is intended to overlap the extending portion of the support layer. Preferably, in this further alternative embodiment the coupling elements are in the form of the adhesive strip. Alternatively, in this alternative embodiment, the roof tile can be free from coupling elements, in this case the support layer can be nailed to a supporting structure, but the extending portion may provide for sufficient impermeability.

Preferably, said support layer is made of a material different from ceramic or porcelain. The support layer may provide additional functionalities to the roof tile. For example, it may be tailored, irrespective of the properties of the ceramic body. Still another advantage is that such layer may hold pieces or parts of the roof tile, which are damaged or broken off, e.g., due to heavy wind or a hailstorm, together. Said layer may thus function as a safety layer to prevent shards from falling from the roof.

In a preferred embodiment the support layer can act as a reinforcing layer or can comprise a reinforcing element or can be attached to the decorative layer through a reinforcing element. Said reinforcing element is preferably adapted to improve the toughness, or impact resistance, of the ceramic body. Thus the thickness of the decorative layer can be reduced, thereby obtaining good hail resistance performance while reducing the weight of the roof tile and of the roof covering. In a preferred embodiment, the support layer can be in form of a sheet that covers all or at least the majority of the lower surface of the decorative layer. In a special embodiment, the support layer may be in the form of one or more strips disposed close to one or more edges of the decorative layer.

According to a preferred embodiment, the reinforcing layer may comprise a metal sheet, for example a steel or aluminum sheet attached to the lower surface of the decorative layer. Preferably, the ceramic body is compressed by the metal sheet. Since the ceramic body is in a compressive state, the impact resistance can be greatly improved, because the compression blocks the propagation of cracks. Moreover, even in case of break, the compressive state helps in disguising the visual effect of superficial cracks. To achieve this goal, the metal sheet is first stretched, for example by means of a mechanical or preferably thermal stretching, and then is bonded to the ceramic body while the metal sheet is still in the stretched state. Subsequently, the stretch is released, by interrupting the mechanical stretching or by cooling the metal sheet itself, thereby establishing a compressive state in the ceramic body. For example, the metal sheet has a coefficient of thermal expansion greater than the coefficient of thermal expansion of the ceramic body. Due to this solution, the reinforcing element can be heated to a stretched state, and then it is bonded to the ceramic body while it is still in the stretched state and subsequently it is cooled down to retract and put the ceramic body in compression.

Preferably the metal sheet can comprise an anticorrosion alloy, like stainless steel, or comprise an anticorrosion coating, for example of zinc, chrome, paint, glaze or a plastic film.

The metal sheet can be attached to the decorative layer with an adhesive layer. Said adhesive layer can comprise one or more glue. The resin can be a thermosetting adhesive or a thermoplastic adhesive. Examples of thermosetting adhesive are epoxy, polyurethane, unsaturated polyester, vinyl ester, cyanoacrylate, reactive hot melt. Examples of thermoplastic adhesive are hot melt, polyester thermoplastic, acrylic resin, vinyl etc. in a preferred embodiment the adhesive is a reactive hot melt polyurethane glue. It is preferred that the adhesive is provided in an amount less than 150 g/sqm, preferably less than 50 g/sqm.

In some embodiments, said adhesive for fixing the support layer to the decorative layer can be the same as the adhesive strip. Preferably, said adhesive for fixing the support layer to the decorative layer can be different from the adhesive strip.

In an alternative embodiment, said support layer may be made of one or more of the materials selected from the group consisting of: a thermoplastic polymer, such as polyvinylchloride, polyethylene, polypropylene and/or polyethylene terephthalate, a thermosetting polymer, such as polyurethane, and/or an elastomer, such as rubber or a thermoplastic elastomer. If polyethylene is used as a material for said layer, high-density polyethylene or HDPE is preferred, although the use of low-density polyethylene or LDPE is not excluded. Another preferred material for the support layer is PVC, in particular rigid PVC. The support layer may also comprise a high amount of filler materials, preferably mineral fillers such as calcium carbonate, talc, chalk, e.g., more than 30 wt % or more than 60% wt of such filler materials. The content of filler should be preferably limited to less than 75 wt %, preferably less than 65 wt % in order to not excessively increase the brittleness of the support layer. Thereto, the support layer may preferably be made of SPC (solid polymer composite) that relates to a polymeric board, preferably in PVC, comprising solid particle filler, like limestone. If said support layer is made of a polymer, the layer may comprise one or more plasticizers. The one or more plasticizers may be present in an amount of less than 20 phr and, in this case, preferably in an amount between 5 phr and 15 phr. In this case, the support layer is of the so-called rigid type. In an alternative, the one or more plasticizers may be present in an amount of minimal 15 phr and, in this case, preferably in an amount of at least 20 phr. In this case, the support layer is of the so-called soft type. A rigid polymeric support layer is preferable over a flexible or soft polymeric support layer since it provides two main advantages. The first advantage is that due to its rigidity the support layer interacts with a reinforcing element, if any, thereby enhancing the reinforcing effect thereof. The second advantage is that a rigid support shows a limited thermal expansion coefficient that is closer to that of the ceramic body, thereby providing a higher stability to the ceramic body.

Preferably, the support layer is made a material having a flexural modulus greater than 1.5 GPa, preferably greater than 3 GPa, more preferably greater than 5 GPa, for example, approximately 8 GPa. Said flexural modulus is preferably less than 15, more preferably less than 10 GPa. The support layer may also comprise a flexural strength between 20 and 90 MPa, for example between 30 and 50 MPa. In fact, the inventors have found that the rigidity of the support layer helps absorbing the impact energy thereby improving the impact strength.

In a particular embodiment, said support layer may be foamed.

According to a further alternative embodiment the support layer may be made of an inorganic material. For example, the support layer may be made of cement, for example a Portland cement board, preferably a fiber cement board. The support layer may be also made of mineral board, like mica, magnesium oxide or other mineral boards.

Preferably the thickness of the support layer is less than 10 mm, even more preferably less than 4 mm. In a preferred embodiment of the invention wherein the support layer comprises a metal sheet, it can show a thickness less than 1 mm, preferably less than 0.7 mm, even more preferably less than 0.5 mm. The metal sheet may have a thickness greater than 0.1 mm, preferably greater than 0.3 mm.

In a particular embodiment, the upper and lower surface of said support layer may converge towards each other. As advantage, the risk at breakage or damage of the roof tile, e.g., when walking over it, may be significantly reduced. For example, the upper surface of said support layer may be substantially parallel to the lower surface of the ceramic body, whereas the lower surface of said support layer may be configured such that, in the installed condition of the roof tile, it is substantially parallel to the slope of the roof. In particular, they may converge towards each other in the direction towards the upper edge of said layer. In a particularly preferred embodiment, the lower surface of said support layer is arranged such that, in the installed condition of two of such roof tiles in subsequent rows of the roof covering, the lower surfaces of the respective layers of these two roof tiles form a generally flat surface. In other words, the transition from the lower surface of the support layer of one roof tile of these two roof tiles to the lower surface of the support layer of the other roof tile is flush or substantially flush. It is noted that in case of such converging surfaces the thickness of said support layer varies. In this case, where reference is made to the thickness of said support layer, this thickness should be interpreted as the average thickness of said support layer. The same applies to the thickness of the roof tile.

Alternatively, the support layer can comprise a supporting element that protrudes from the lower surface of the support layer, or that protrudes from the plane of the support layer. Said supporting element is configured to rest on the roof structure adjusting the inclination of the roof tile in the roof covering so that the risk of breakage or damage of the roof tile, e.g., when walking over it, may be significantly reduced. Said supporting element is preferably disposed closer to the upper edge of the roof tile than to the lower edge. Preferably said supporting element is disposed below the decorative layer. In a preferred embodiment, the supporting element runs substantially along the entire length of the roof tile. The supporting element is preferred above a support layer with converging surfaces in an attempt of reducing cost and weight. Further, the support element is more adapted than the converging surfaces solution for support layer with low thickness like, for example, in the case of the support layer made of a metal sheet.

As mentioned above the support layer, can be fixed to the decorative layer through a reinforcing element. In a preferred embodiment, the reinforcing element comprises a resin, for example can be constituted by a resin. The resin can be a thermosetting resin or thermoplastic resin. Examples of thermosetting resin are epoxy, polyurethane, unsaturated polyester, vinyl ester, cyanoacrylate. Examples of thermoplastic resin are hot melt, reactive hot melt, polyester thermoplastic, acrylic resin, vinyl etc. Preferably the resin is a rigid resin. In fact, the inventors have found that a rigid resin, rather than flexible resin, shows a higher absorption of the energy rather than flexible resin. In particular, according to a preferred embodiment of the invention the reinforcing element comprises an epoxy resin. In some embodiment of the invention, the resin is a bicomponent resin, i.e., a thermosetting resin obtained by curing at low temperature (for example at room temperature) a mixture of two components, namely a resin and a hardener. When the two components of the resin are mixed together the curing reaction starts so that it is not necessary to activate the cure by providing external energy, like heat, UV or EB radiation. Said external energy could be optionally provided in order to accelerate the curing process.

According to a preferred embodiment, the resin material permeates a lower surface of the decorative layer, in particular of the ceramic body, and in particular an open porosity thereof. The inventors have found that, due to this solution, the impact resistance of the roof tile, is highly increased. Moreover, in this way it is possible to improve the impact resistance of the roof tile without the necessity to add further rigid or resilient reinforcing elements like rubber layer, fiberglass or metal sheets. In fact, the resin permeating the pores of the decorative layer substantially improves the transmission and dissipation of the impact stress through the roof tile so that a lower portion of said energy is absorbed by the decorative layer improving the impact resistance thereof. Since it is not necessary to add rigid reinforcing elements, the resulting roof tile is lighter and thinner. Moreover, the resin constitutes a hinder to the propagation of cracks in the decorative layer. Furthermore, in case of superficial cracks of the ceramic body, the reinforcing layer keeps the ceramic body itself coherent, and preferably compacted, thereby disguising the visual appearance of the superficial cracks.

According to a preferred aspect of the invention the resin comprises a viscosity at 20° C. less than 1000 mPas, preferably less than 800 mPas, more preferably less than 600 mPas, for example approximately 400 mPas. Within the scope of the invention viscosity means the viscosity of the uncured resin, for example the viscosity of the mixture of the two components before the completion of the curing, i.e., during the so-called pot life. In fact, the inventors have found that if the resin is sufficiently fluid, during its application onto the back of the decorative layer, it can permeate the pores thereof. In practice, when the resin permeates the pores of the ceramic body it substantially forms a "composite polymer-ceramic layer" that significantly improves the impact strength of the decorative layer. Moreover, due to the reinforcing layer here described it is possible improve the impact resistance and fatigue behavior of relatively thin ceramic body, thereby reducing the weight of the roof tile and improving the maneuverability. It is noted that, according to a preferred solution the resin is in a substantially liquid state during the manufacturing process of the roof tile. Anyway, it is not excluded that the resin is in a pasty or gel state during the manufacturing process, for example showing a thixotropic behavior in order to reach a sufficient fluidity to permeate the pores of the decorative layer under predetermined process conditions, for example during a pressing step.

In some embodiment the resin may also show a shrinkage, after curing, comprised between 0.5 and 15% for example between 1 and 10%. The inventors have surprisingly found that a resin showing this characteristic during its curing retires significantly. Since during curing the resin is the only component of the roof tile that shrinks, it compresses the decorative layer disposed above thereby reinforcing the ceramic body itself. This effect can be further enhanced if the resin permeates the lower surface of the decorative layer. In fact, if the resin of the intermediate layer permeates the lower surface of the decorative layer the strong bonding within the two layers helps the compressive action of the resin. Moreover, this reinforcing mechanism due to the compressive action of the resin may join the reinforcing action due to the filling of the pores and the improved stress transfer mechanism.

This compressive effect is evident by measuring the bowing of the roof tile, i.e. the planarity deviation thereof. Usually, the planarity deviation of the ceramic body is reflected into the bowing of the whole roof tile. The inventors have found that after curing of the resin the roof tile shows a planarity deviation which is higher than the planarity deviation of the sole decorative layer before application of the resin. This means that the ceramic body is compressed and reinforced. Therefore, according to a preferred embodiment, after gluing the ceramic body a planarity deviation less than 1.5 mm, preferably less than 1 mm, more preferably less than 0.8 mm. Within the context of the present application, the planarity deviation is defined as the height difference between the extremal portion and the central portion of an edge of the decorative layer. In particular within the scope of the present invention the planarity deviation is measured by placing the extremes of one edge of the decorative layer, on a horizontal plane and measuring the distance between the middle of the edge from that horizontal plane. According to an embodiment of the invention, upon this compressive effect the planarity deviation of the roof tile after gluing is at least 1%, preferably at least 5%, for example at least 10% higher than the planarity deviation of the ceramic body before gluing.

The inventors have also found that preferably the resin may be free from fillers, like mineral fillers. In fact, the inventors have found that the presence of fillers if on one hand improves mechanical properties of the resin as such, on the other hand increases the viscosity of the resin thereby forming an obstacle to the permeation of the decorative layer. In case of presence of said fillers, it is preferable that they are limited to less than 10% wt of the resin.

The resin preferably comprises a tensile strength between 50 and 90 MPa, more preferably between 60 and 80 MPa, for example 75 MPa. It is noted that the resin preferably comprises a compressive strength between 90 and 130 MPa, more preferably between 100 and 120 MPa, for example 110 MPa. The inventors have found that such strength is sufficient to provide a rigid matrix for the composite polymer-ceramic layer that allows dissipation of the impact energy. It is also noted that the resin may preferably show a hardness value of at least 50 measured on a Shore D scale. Preferably the resin may comprise a Young modulus comprised above 0.5 GPa, more preferably above 1 GPa. It may also be preferable that the Young modulus is below 3 GPa, more preferably below 2 GPa. For example, the Young modulus can be comprised between 1 GPa and 1.5 GPa, preferably around 1.3 GPa.

Preferably the resin covers at least a portion of the lower surface of the decorative layer, for example the majority, i.e., at least 50 percent, of the lower surface of said decorative layer. More preferably the resin covers 80 percent or more of the lower surface of the decorative layer, for example it covers 100 percent of the lower surface of the decorative layer so that the effect of distribution and dissipation of the impact energy is obtained for an impact occurring in any point of the decorative layer. The resin is preferably provided onto the lower surface of the decorative layer in an amount greater than 50 g/sqm, more preferably greater than 100 g/sqm, even more preferably greater than 150 g/sqm for example 220 g/sqm so that the resin is in an amount that is sufficient to fully permeate the open pores of the lower surface of the decorative layer. It is also preferable that the resin is provided in an amount less than 300 g/sqm, more preferably less than 250 g/sqm.

It is also preferable that the resin is provided in an amount sufficient to overflow from said open porosity in order to act as a glue for the support layer. In other words, it is preferable that the resin partially permeates the open porosity of the decorative layer and partially coats the lower surface thereof for forming an intermediate layer between the decorative layer and the support layer and improving the transfer of energy. Said effect of transfer of energy is further improved if the support layer is directly fixed to the intermediate layer and, in particular, to said portion of the resin that coats the lower surface of the decorative layer, so that the intermediate layer acts as an adhesive layer that bonds together the decorative layer and the support.

Although according to a preferred embodiment of the first possibility the reinforcing element is free from any filler or rigid element, it is possible that according to some alternative embodiments the reinforcing element can comprise a rigid element for example at least partially embedded into the resin material. The rigid element may comprise fibers like glass fibers carbon fibers, polymeric fibers, for example aramid or polyamide fibers, or ceramic fibers, for example boron or silicate fibers. The fibers may be woven or non-woven fibers, for example with fibers disposed at different orientations, and may be in in form of mat, fleece or cloth. Fillers can also comprise mineral such as calcium carbonate, talc, silica, mica, wollastonite, ash and others. In the case a rigid element, the reinforcing effect of the reinforcing layer can be caused by the sole presence of the rigid element or by a combination of the effects provided by the rigid element and the resin.

According to a preferred embodiment of the present invention the ceramic body is made of porcelain since porcelain provides for a better frost and mechanical resistance with respect to other ceramic material.

Although a ceramic body made of porcelain is a preferred embodiment, it is noted that the system may alternatively comprise a roof tile having a body of a red ceramic material, clay ceramic or any other material used for roof covering, especially brittle material like, for example, natural stone or slate.

According to a preferred aspect of the invention the ceramic body may comprise, at least in correspondence of its lower surface, an open porosity adapted to allow the resin to permeate the ceramic body itself. Thus, according to a preferred embodiment of the invention, the ceramic body may comprise an apparent porosity between 0.1% and 10% determined according to ASTM C373, more preferably between 2% and 8%, for example 6%. Since, the pores of the material, especially the closed pores may represent weak points of the material itself, it is preferable that the ceramic body comprises an apparent porosity lower than 15%, preferably lower than 10% measured according to ASTM C373. Furthermore, the ceramic body may preferably have a volume of the open pores comprised between 0.01 cc (cubic centimeter) and 1 cc, more preferably between 0.10 cc and 0.90 cc, for example 0.60 cc. The abovementioned ranges and values of apparent porosity provide the optimum balance between intrinsic mechanical properties of the ceramic body and the resin permeability thereof thereby providing the best bonding between the resin without affecting the intrinsic mechanical properties of the ceramic body. In this way the pores are big enough to be filled by the resin while at the same time they are sufficiently small to not compromise the mechanical properties of the ceramic body Preferably the roof tile further comprises a glaze coating, which is situated above said ceramic body, i.e., at least on the upper surface of the ceramic body. Hereby, it is noted that the glaze coating is not necessarily situated directly above the ceramic body, however, this is preferably the case. The glaze coating contributes to the overall weather and frost resistance of the roof tile, since water can mainly only be absorbed via the edges of the roof tile. Another advantage is that the roof tile, due to the presence of the glaze coating, may be provided with a variety of textures, designs and colors. Other advantages that may be obtained by the presence of the glaze coating are the prevention or at least the minimization of moss grow, easy cleanability and/or UV-resistance.

Further, according to an embodiment of the invention, the glaze coating may cover at least one edge of the roof tile, for example three edges of the roof tile. In particular, since the roof tiles are destined to be installed partially overlapping each other, there is often always one edge, namely an upper edge, that in use will be place below another roof tile and that consequently is not exposed to weather and water. On the contrary the other three edges are usually exposed to weather and water. By providing a glaze coating on said exposed edges, the overall weather and frost resistance of the roof tile is improved. Preferably said exposed and glaze edges may be rounded or chamfered edges, for example they may be bullnose edges.

In a preferred embodiment, the glaze coating comprises a glaze layer of uniform color, which, in case of said glaze coating comprising a print, is situated below said print. As advantage, the glaze layer of uniform color may hide imperfections in the upper surface of the ceramic body. Although the glaze layer of uniform color is preferably of a white, beige or grey color, the glaze layer may be of another color as well. In the latter case, the advantage may be obtained that the ink lay-up, which is needed for obtaining the desired colors in the aforementioned print, can be lowered.

Preferably, the glaze coating comprises a transparent or translucent glaze layer, which, in case of said glaze coating comprising a print, is arranged over said print. By having such glaze layer, the advantage may be obtained that the print can be protected from wear. Other advantages that may be obtained by the use of such transparent or translucent glaze layer are the minimization of moss grow, easy cleanability and/or UV-resistance. It is noted that the aforementioned glaze coating may be a so-called wet or dry glaze. In a particular embodiment, the color or appearance of the ceramic body substantially matches the color or appearance of the front face of the roof tile. As an advantage, no major color or appearance differences are visible between for example the edges of the ceramic body and the front face of the roof tile.

In a preferred embodiment, said glaze coating comprises a décor, which may simulate a natural product such as stone, natural slate or wood. In the latter case, the décor may show wood grains or wood nerves. As an advantage, the roof tile may have the look of a natural product such as natural slate or wood, while being provided with better weather and frost resistance than roof elements that are actually made of such materials. In a particular embodiment, said décor comprises a print. In other words, the décor, or at least part of the décor, is provided by means of a printer or printing machine. Various techniques may be used to provide said print, such as screen printing, rotary serigraphy or digital printing, the latter technique being a preferred one. In case of digital printing, an inkjet printer may be used, which may be of the single pass type. In particular, a device similar to the one disclosed in EP 1 038 689 A1 may be used, wherein each roof tile is printed separately with a single pass of the roof tile underneath the fixed print heads of the device. With such device, the possibility is offered to print in certain areas of the upper surface of the roof tile. For example, the device may be used to print multiple images, each of these images being present in respective areas of the upper surface of the roof tile. These images may be separated from each other by means of intermediate lines, transitions or edges, which are not necessarily provided by means of printing, although this is not excluded.

Preferably, the front face of the roof tile represents or forms an image of a plurality of roof tiles. In such case, the roof covering may have the appearance of a conventional one, however, with the advantage of being composed of fewer roof tiles. That the roof covering is composed of fewer roof tiles allows reducing the overall risk at water penetration. Indeed, the number of joints, present between the roof tiles in the roof covering, in which water might penetrate, may be minimized. For forming such kind of front face, a décor with multiple images may be applied, e.g., with each image representing a single roof tile. These multiple images may be provided by respectively printing in certain areas of the upper surface of the roof tile, as previously described. Thereto, a device such as the device known from EP 1 038 689 A1 may be applied. In such front face, the borders or transitions between adjacent images of roof tiles may be represented by means of a print or of a relief.

In case of the glaze coating being provided with a print, it is advantageous that the ceramic body substantially matches the general color or appearance of that print. Indeed, in that way, any substantial contrast between the edges of the ceramic body and the print may be excluded. For accomplishing that goal, the ceramic body may be provided with one or more color pigments. The pigments may then be chosen such that they provide the ceramic body with a color or appearance that substantially matches the color or appearance of the front face of the roof tile. It is noted that, in general, the ceramic body may be provided with one or more color pigments, irrespective of the ceramic body substantially matching the color or appearance of the front face of the roof tile.

According to an alternative embodiment wherein the roof tile comprises a ceramic body, the roof tile may be free from said glaze coating and the body may comprise a body décor. For accomplishing that goal, the ceramic body may be provided with one or more color pigments. The pigments may then be provided into the body randomly or according to a predetermined pattern or drawing. In this way the body décor may represent a natural product such as natural slate or wood. The body décor may also represent multiple images substantially in the same manner described above with reference to the glaze coating.

In an embodiment, the upper surface of the roof tile is provided with a relief, which preferably is formed by a plurality of excavations present in said upper surface of the roof tile. By the relief, the texture of the roof tile, at the upper surface thereof, may simulate the texture of a natural product such as stone, natural slate or wood. In the latter case, the relief may for example simulate the texture of wood grains or wood pores.

The relief or at least part of the relief may also concern one or more chamfers present at the upper surface of the roof tile, which may be provided at one or more edges of the roof tile. For example, the relief or at least part thereof may concern a chamfered perimeter of the roof tile, for example in the form of a bullnose edge. In case of a décor with multiple images, the relief may also be used to represent lines or transitions between these images. For example, these lines or transitions may be represented in the form of depressions in the upper surface of the roof tile, situated between the images. Various possibilities may be applied for providing the relief. Preferably, the relief is formed in the upper surface of the ceramic body, in which case the relief manifests itself through the glaze coating up to the upper surface of the roof tile. Alternatively, the relief or at least part of the relief may be formed in the glaze coating, such that it is situated substantially or completely above the ceramic body. In case of said glaze coating being provided with a print, said relief may be performed "in register" with said print, which means that the relief is in alignment with the print. By having the relief "in register" with the print, the natural look or appearance of natural products such as wood or natural slate is better simulated. For example, in case the print is a wood pattern with lines simulating wood grains, the relief may be formed by lines following the course of said lines of the printed wood pattern or by a plurality of successive dashes having a configuration following the lines of the printed wood pattern.

For having the relief being performed "in register" with the print, the techniques known from WO 2015/092745 A1 may be used.

In a particular embodiment, the lower surface of the roof tile, and in particular of the ceramic body, is flat. More in detail said lower surface is free from any structure or comprises a relief structure having a depth or a height less than 1 mm, preferably less than 0.5 mm, more preferably less than 0.2 mm. Due to this feature the adhesion between the ceramic body and the reinforcing layer is significantly increased.

Preferably, the thickness of the roof tile is less than 10 mm, for example less than 8 mm, more preferably less than 6 mm. The thickness can be greater than 1 mm, preferably greater than 3 mm. In fact, due to the reinforcing layer is possible to reduce the thickness of the ceramic body and thus reducing weight of the roof tile itself.

In a preferred embodiment, the ceramic body forms at least 50%, more preferably at least 75%, and still more preferably at least 90% of the thickness of the roof tile. In that way, the roof tile has optimal advantage of the beneficial characteristics of porcelain.

Preferably the roof tile, may have a weight expressed in kg/sqm less than 20 kg/sqm, more preferably less than 15 kg/sqm, even more preferably less than 10 kg/sqm.

The inventors have found that the roof tile may be made relatively wide. For example, the length of the roof tile may be larger than its wide. Also, not necessarily combined with the previous, the roof tile may be at least 350 mm wide and preferably at least 500 mm long. That the roof tile may be made relatively long, offers the advantage that the roof or roof covering may be composed of a relatively small amount of roof tiles, thereby minimizing the number of joints present in the roof covering and consequently the risk at water penetration. Within the scope of the present application the width of a roof tile is that dimension that in use is intended to be disposed horizontal, i.e., parallel to the roof ridge, whereas the length is that dimension that in use is intended to be disposed inclined according to the slope of the roof. It is to be noted that due to the presence of the reinforcing layer, the thickness of the ceramic body as well as the weight thereof can be reduced, it is possible to further increase the dimensions of the roof tile, in particular of width and/or length, preferably length in such a way to further reduce the number of joints between the tiles.

It is noted that the fact that the roof tile comprises an anchoring element forms an inventive aspect that is independent from other features of the roof tiles, in particular from the presence of the coupling elements. Thereto the present invention, in accordance with a second independent aspect, the invention refers to a roof tile comprising a decorative layer, having at least a ceramic body, and a support layer disposed below the decorative layer, wherein the roof tile comprises an upper edge, a lower edge which is opposite to the upper edge and two opposite side edges, said side edges being transversal to the upper edge, wherein said roof tile comprises at least one anchoring element for anchoring the roof tile to a structure or framework. Preferably the anchoring element comprises an attachment hole or is suitable to be perforated by an attachment element like a nail or a screw. It is particularly preferred that the anchoring element comprises a tilting arm that is able to tilt around one of its ends in order to adjust its inclination relative to the plane of the roof tile. It is also particularly preferred that the roof tile comprises a support layer and that the anchoring element is provided in or on said support layer. It is noted that the roof tile according to this second independent aspect can comprise one or more of the features described in relation to the first aspect.

In a special and preferred embodiment the roof tile may comprise:

- a decorative layer, having at least a ceramic body, and a support layer disposed below the decorative layer, wherein the roof tile comprises an upper edge, a lower edge which is opposite to the upper edge and two opposite side edges, said side edges being transversal to the upper edge;
- a first coupling element configured for being coupled to an adjacent roof tile in a roof covering and wherein said first coupling element is provided at least at one side edge of the roof tile, preferably said first coupling element can be in form of an adhesive strip;
- an anchoring element for anchoring the roof tile to a structure or framework, preferably said anchoring element can be disposed in a position that is proximal to said first coupling element, more preferably said coupling element being disposed between a side edge of the decorative layer and the anchoring element.

The inventors have found that the combination of the anchoring element and the coupling element may provide for an optimal waterproofness of the roof covering while at the same time speeding up the installation operation. The inventors have also found that this combination is so effective in improving the waterproofness of the roof covering that it is possible to reduce the dimension of the roof tile itself, thereby increasing the number of joints between the roof tiles without affecting the waterproofness of the performances of the tile. Due to said reduction of dimension the maneuverability and the weight of the roof tile is improved as well as the speed of the installation operation. Preferably, the roof tile in this special embodiment may show a length comprised between 150 and 500 mm, more preferably between 200 and 400 mm, even more preferably between 250 mm and 350 mm. In this special embodiment the length can also be equal or lower to the width of the roof tile.

In this special embodiment the roof tile can further comprises a support layer disposed below the decorative layer, preferably said support layer comprising at least an extending portion that extends beyond one of the edges of the decorative layer, preferably one of the side edges. Said first coupling element and said anchoring element being provided in or on said support layer, in particular on said extending portion.

In this special embodiment, the roof tile can comprise on or more attachment hole, preferably provided in the support layer, in particular in an extending portion thereof that extends beyond the upper edge of the decorative layer.

It is to be noted that a roof covering comprising a plurality of roof tile forms an independent aspect of the invention. Said roof tile can comprise one or more of the features described in relation to the first or second aspect.

Figure 2:
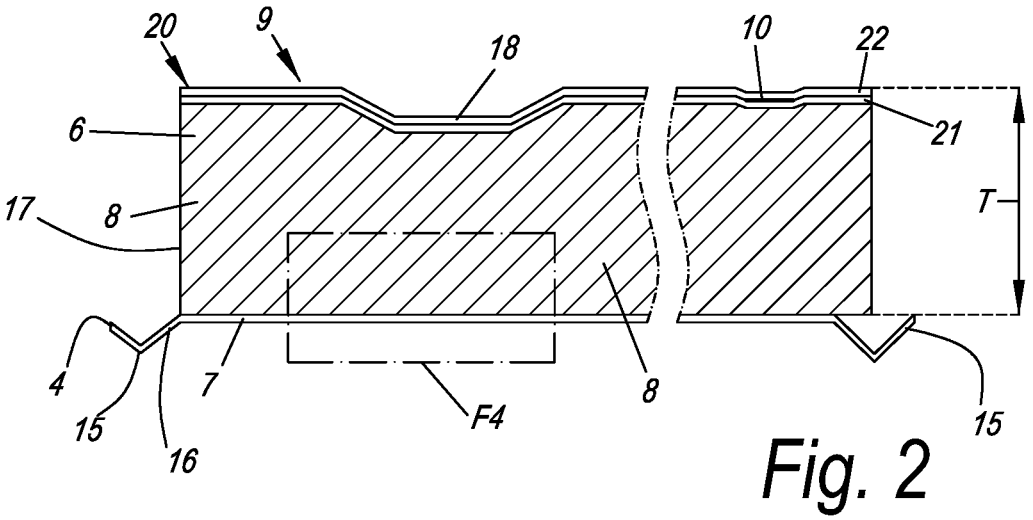
FIG. 2 represents an enlarged cross-section according to line II-II in FIG. 1.
Figure 3:
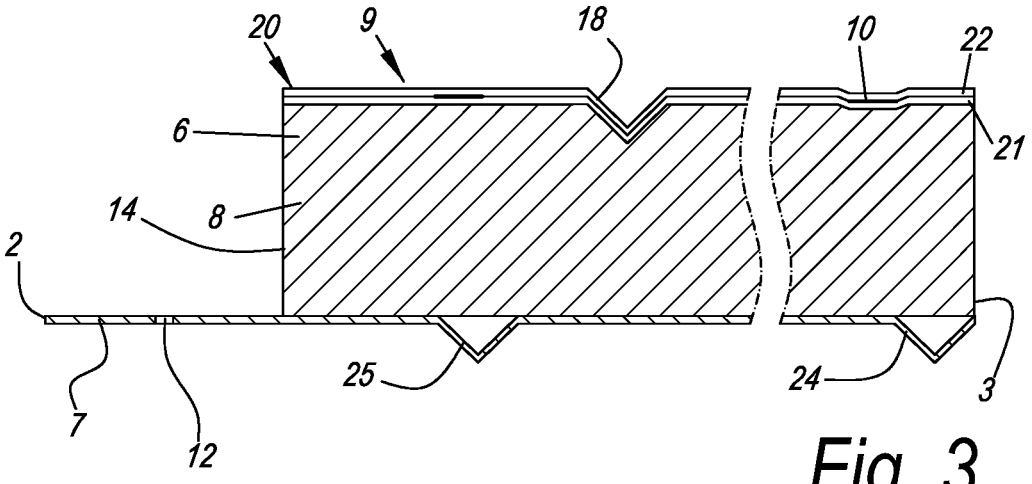
FIG. 3 represents an enlarged cross-section according to line in FIG. 1.
Figure 4:
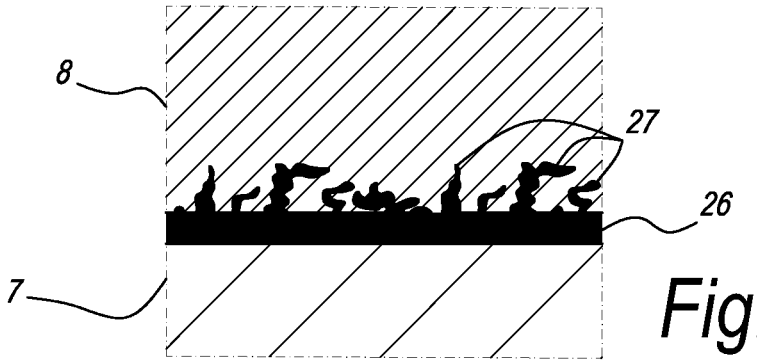
FIG. 4 represents an enlarged view of detail F4 of FIG. 3, in an alternative of said first embodiment.
Figure 5:
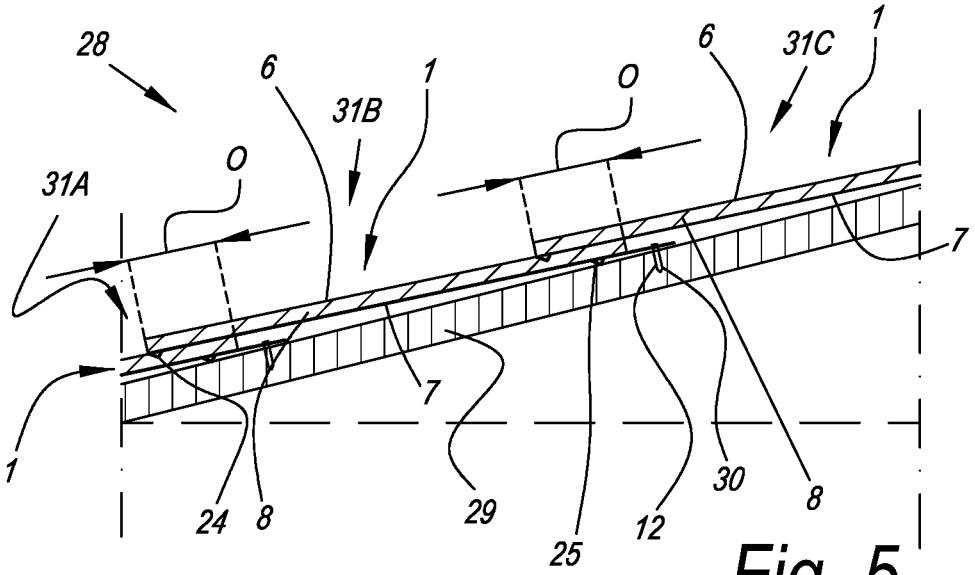
FIG. 5 represents a cross-sectional side view of part of an installed roof covering with roof tiles of the first embodiment.
Figure 6:
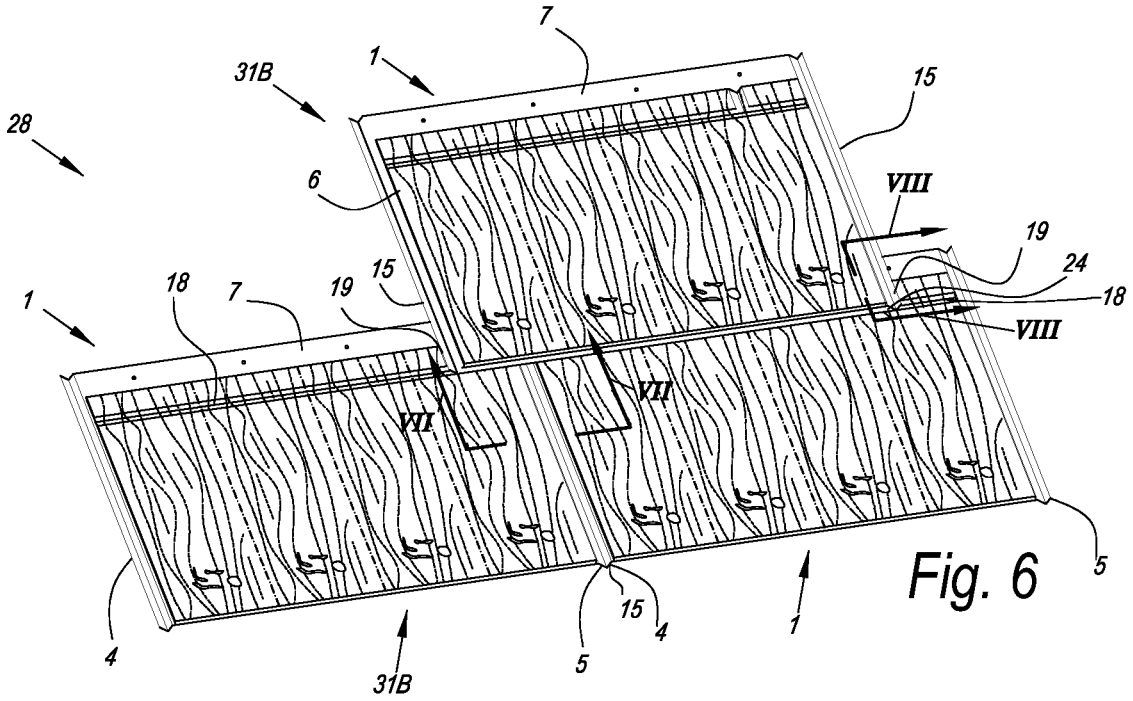
FIG. 6 represents a perspective view of a roof covering comprising roof tile according to a first preferred embodiment, with a view on the front face of the roof tiles.
Figure 7:
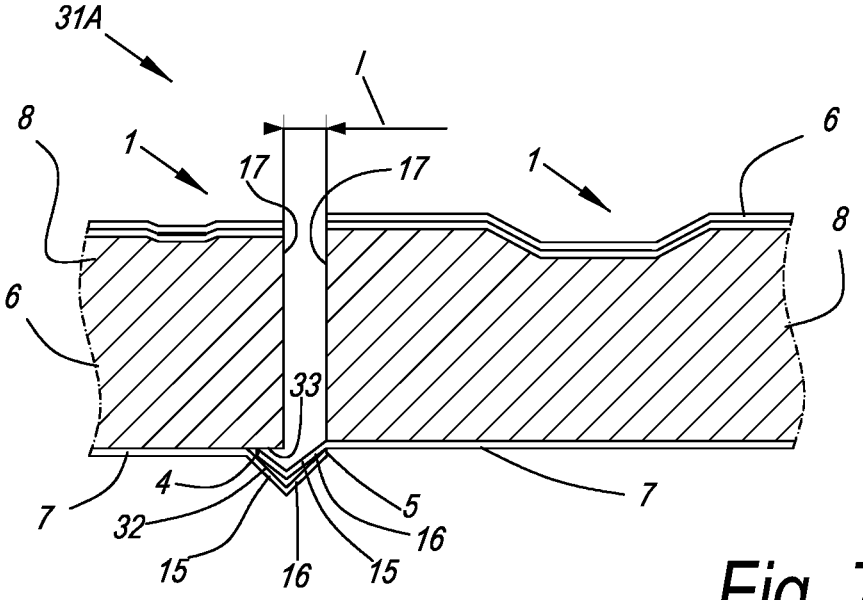
FIG. 7 represents an enlarged cross-section according to line VII-VII in FIG. 6.
Figure 8:
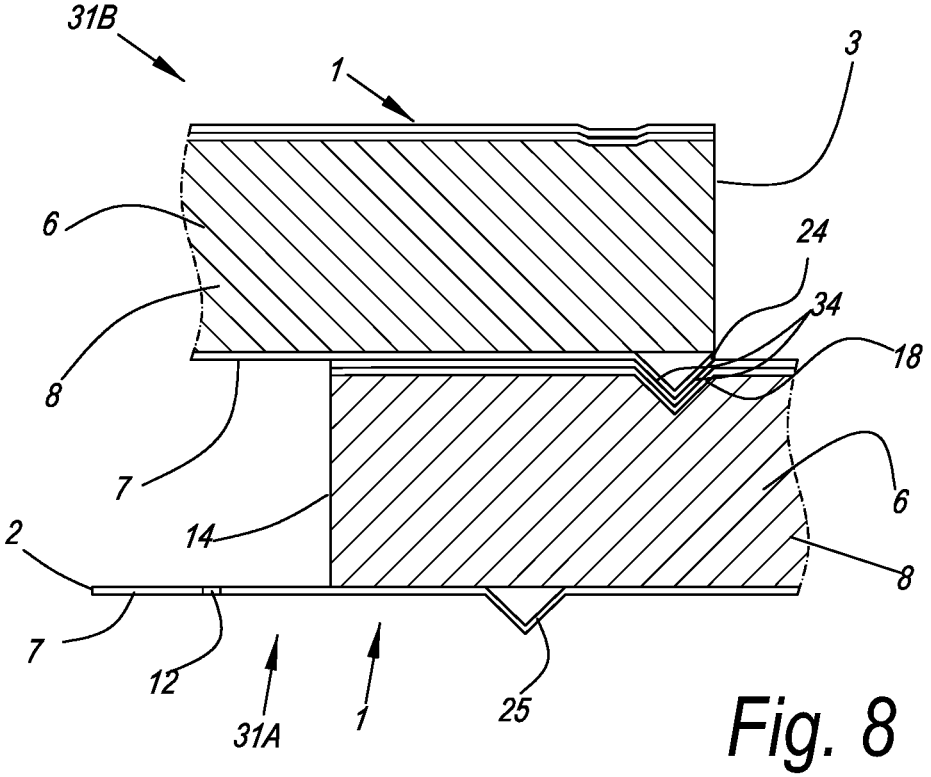
FIG. 8 represents an enlarged cross-section according to line VIII-VIII in FIG. 6.
Figure 9:
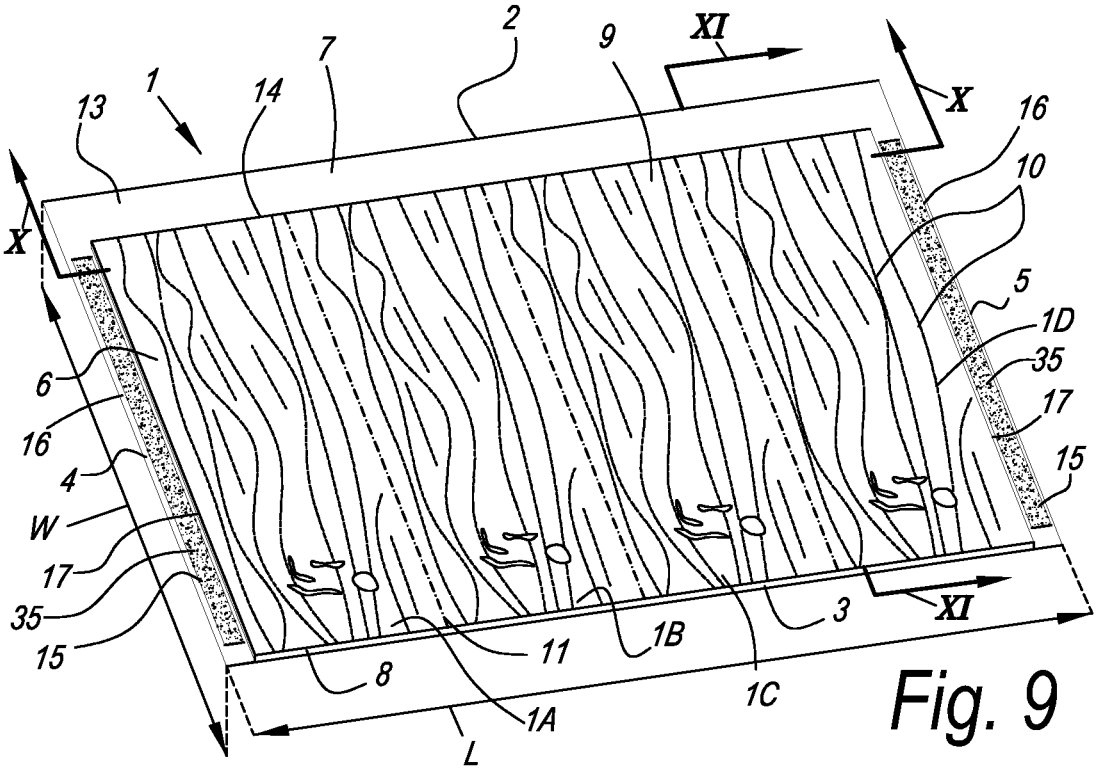
FIG. 9 represents a perspective view of a roof tile in a second preferred embodiment, with a view on the front face of the roof tile.
Figure 12:
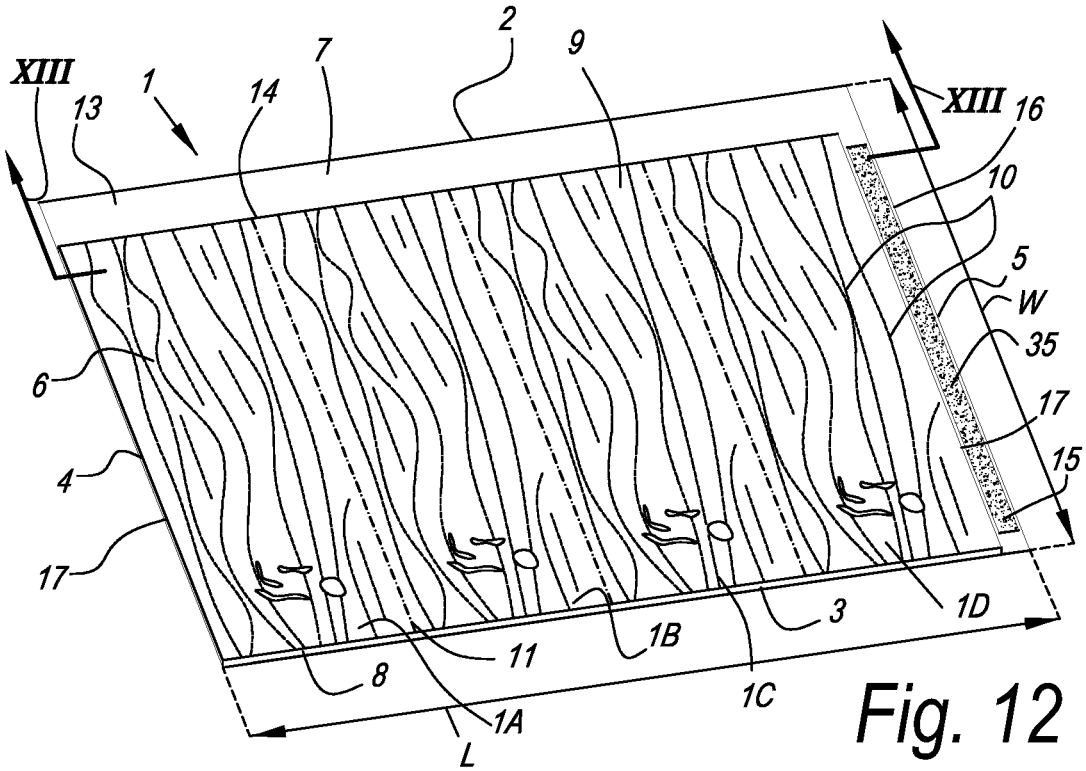
FIG. 12 represents a perspective view of a roof tile in an alternative of a second preferred embodiment, with a view on the front face of the roof tile.
Figure 10:
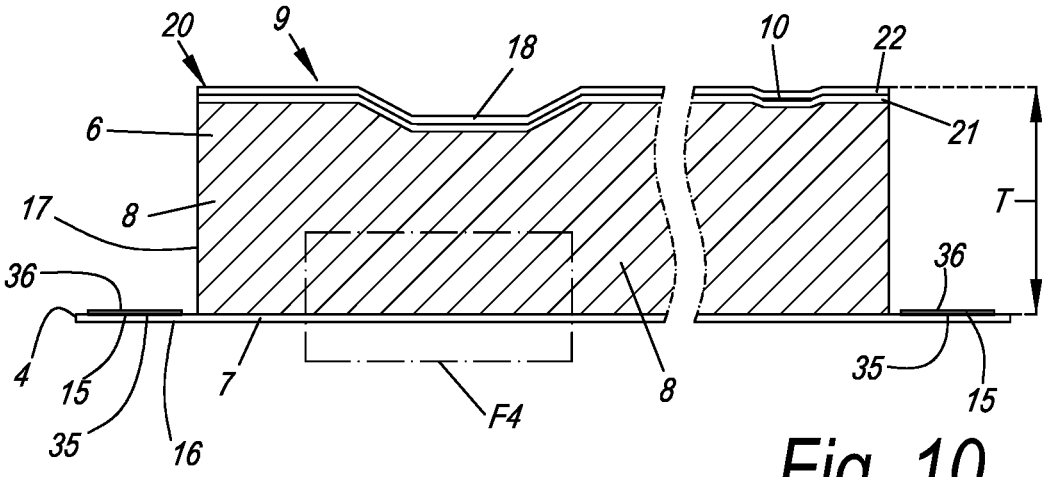
FIG. 10 represents an enlarged cross-section according to line X-X in FIG. 9.
Figure 11:
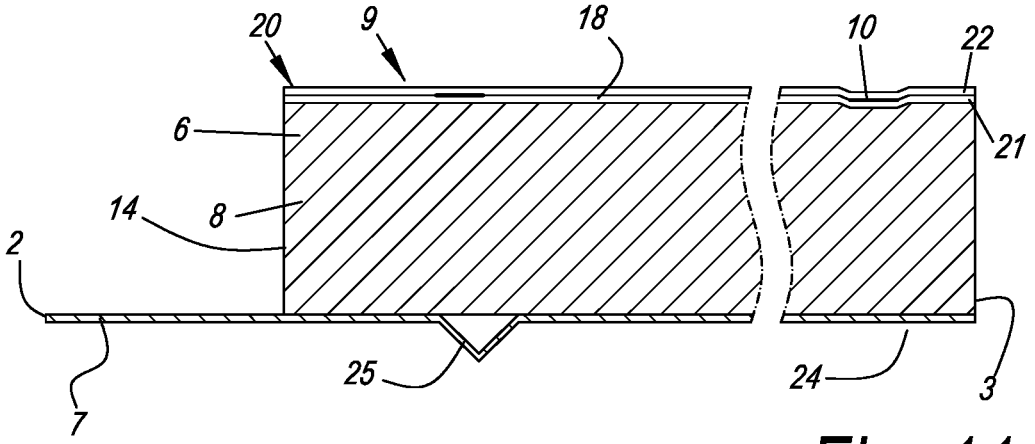
FIG. 11 represents an enlarged cross-section according to line XI-XI in FIG. 9.
Figure 13:
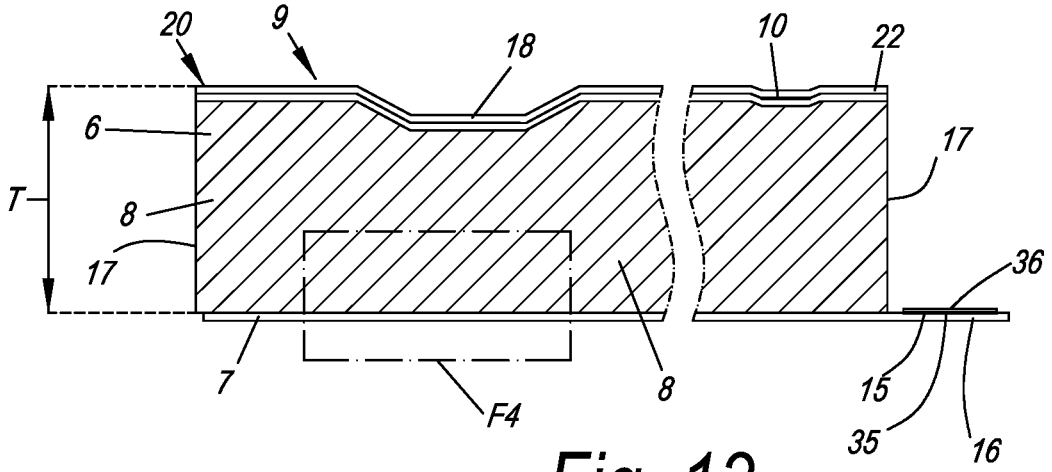
FIG. 13 represents an enlarged cross-section according to line XIII-XIII in FIG. 12.
Figure 14:
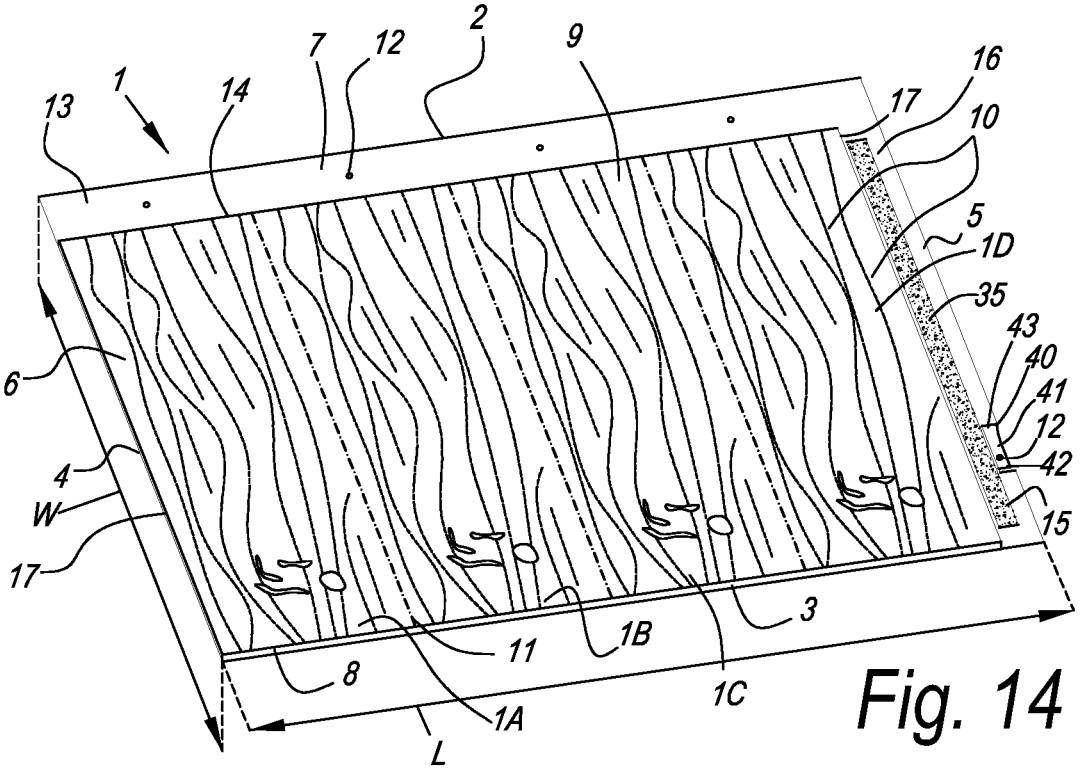
FIG. 14 represents a perspective view of a roof tile according to a special embodiment and to a second independent aspect of the invention.
Figure 15:
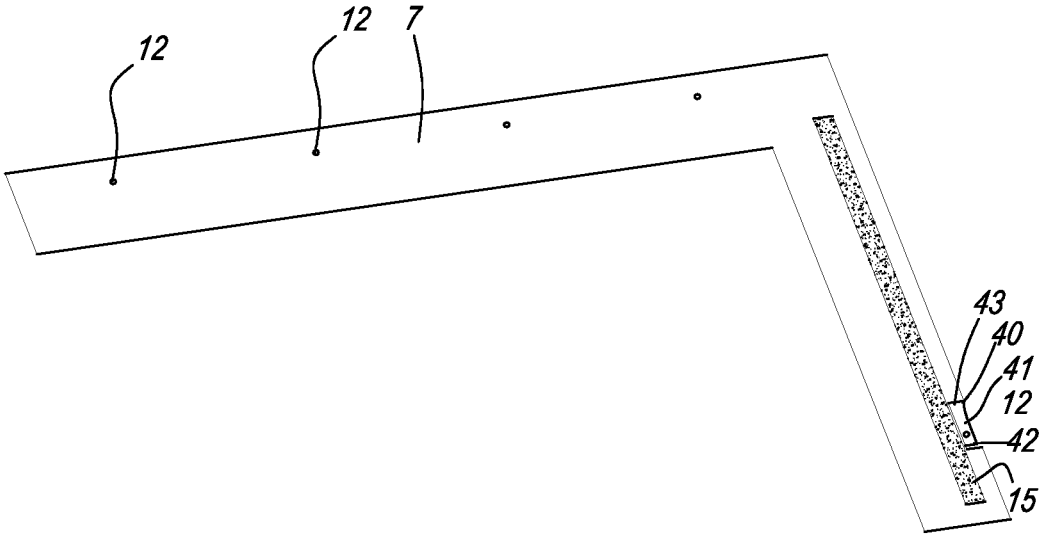
FIG. 15 represents a perspective view of a support layer of the roof tile of FIG. 14.
Figure 16:
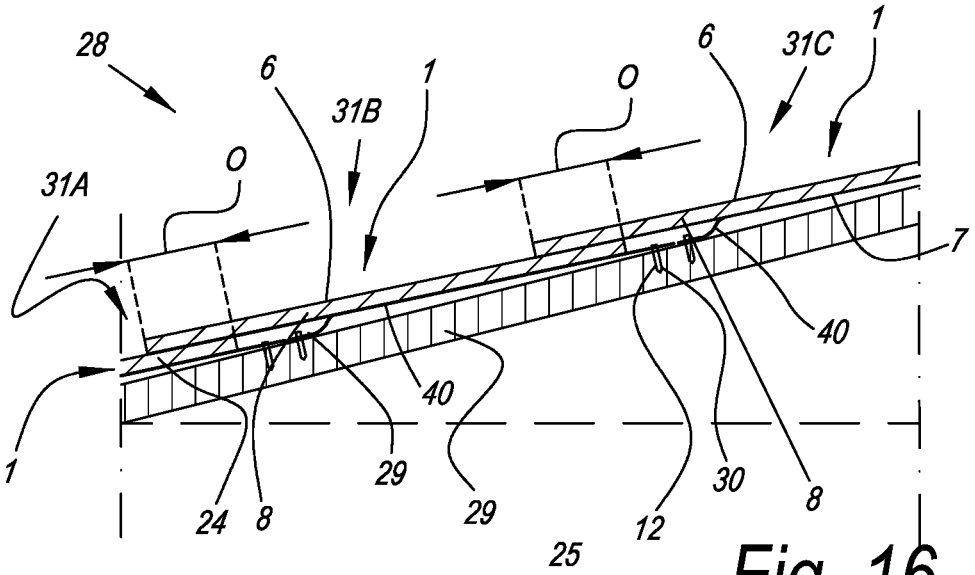
FIG. 16 represents a cross-sectional side view of part of an installed roof covering with roof tiles of FIG. 14.
Figure 17:
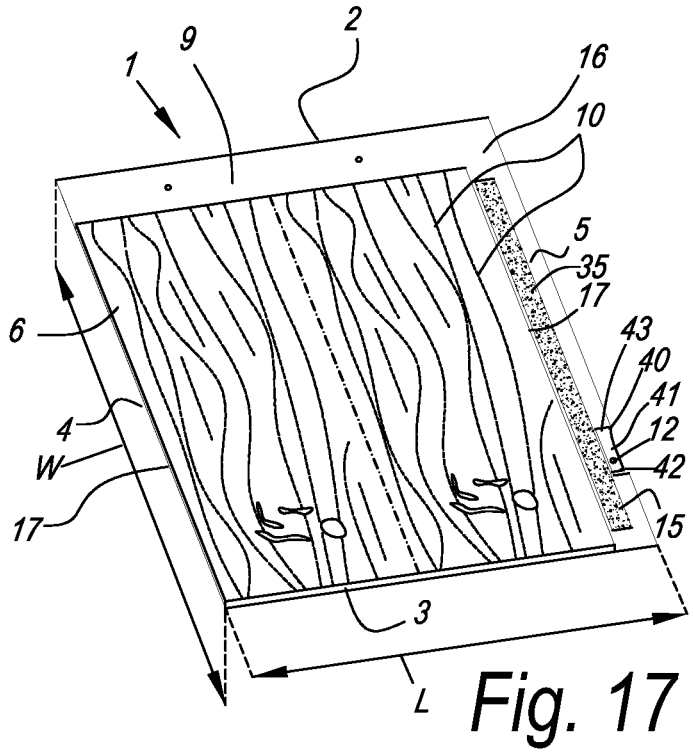
FIG. 17 shows a variation of the roof tiles of FIG. 14.

With the intention of better showing the characteristics of the invention, in the following, as an example without any limitative character, several preferred forms of embodiments are described with reference to the accompanying drawings, wherein:

FIG. 1 represents a perspective view of a roof tile in a first preferred embodiment, with a view on the front face of the roof tile;

FIG. 2 represents an enlarged cross-section according to line II-II in FIG. 1;

FIG. 3 represents an enlarged cross-section according to line in FIG. 1;

FIG. 4 represents an enlarged view of detail F4 of FIG. 3, in an alternative of said first embodiment;

FIG. 5 represents a cross-sectional side view of part of an installed roof covering with roof tiles of the first embodiment;

FIG. 6 represents a perspective view of a roof covering comprising roof tile according to the first preferred embodiment, with a view on the front face of the roof tiles;

FIG. 7 represents an enlarged cross-section according to line VII-VII in FIG. 6;

FIG. 8 represents an enlarged cross-section according to line VIII-VIII in FIG. 6;

FIG. 9 represents a perspective view of a roof tile in a second preferred embodiment, with a view on the front face of the roof tile;

FIG. 10 represents an enlarged cross-section according to line X-X in FIG. 9;

FIG. 11 represents an enlarged cross-section according to line XI-XI in FIG. 9;

FIG. 12 represents a perspective view of a roof tile in an alternative of a second preferred embodiment, with a view on the front face of the roof tile;

FIG. 13 represents an enlarged cross-section according to line XIII-XIII in FIG. 12;

FIG. 14 represents a perspective view of a roof tile according to a special embodiment and to a second independent aspect of the invention;

FIG. 15 represents a perspective view of a support layer of the roof tile of FIG. 14;

FIG. 16 represents a cross-sectional side view of part of an installed roof covering with roof tiles of FIG. 14; and FIG. 17 shows an alternative of the roof tiles of FIG. 14.

FIG. 1 represents a perspective view of a roof tile 1 according to a first preferred embodiment of the present invention, with a view on the front face of the roof tile 1.

The roof tile 1 is mainly rectangular and, in the represented example, rectangular and oblong. Furthermore, the roof tile 1 has an upper edge 2 and a lower edge 3, whereby, in the installed condition of the roof tile 1, the upper edge 2 is directed towards the top of the roof, whereas the lower edge 3 is directed towards the bottom of the roof. Also, the roof tile 1 has two opposite side edges 4-5. The length L of the roof tile 1 is larger than its width W. The length L of the roof tile 1 may be at least 250 mm and preferably at least 500 mm. It is to be noted that the length L of the roof tile 1 correspond to an upper edge 2 and the lower edge 3, and defines that dimension that is destined to be placed horizontally in use. Consequently, the width W correspond to the side edges 4-5.

The roof tile 1 comprises a decorative layer 6 and a support layer 7 disposed below the decorative layer 6. The decorative layer 6 comprises a ceramic body 8, preferably made of porcelain, and has an upper surface 9 provided with a décor 10. In the illustrated example, said décor 10 represent a wood pattern. It is noted that the décor 10 can represent stone, slate pattern or any other kind of desired image. It is to be noted that the décor 10 is printed, more preferably digitally inkjet printed using ceramic pigments. Advantageously, the décor 10 represents or forms an image of a plurality of roof tiles 1A-1B-1C-1D. In the example the borders or transitions 11 between the roof tiles 1A-1B-1C-1D are simulated by printed décor. Alternatively, said transition can be formed by excavations, which form part of the relief at the upper surface 2 of the roof tile 1.

In the example shown in FIG. 1, the roof tile 1 comprises attachment holes 12 for fixing the roof tile 1 to a roof structure. In the example the attachment holes are advantageously made in the support layer 7, in particular in an extending portion 13 of the support layer that extends beyond an upper edge 14 of the decorative layer 6. Said attachment holes are aligned parallel to the upper edge 2 of the roof tile 1.

Furthermore, the roof tile 1 comprises first coupling elements 15, for coupling with coupling elements of an adjacent roof tiles, which are provided at the side edges 4-5 of the roof tiles 1 itself. Preferably, said first coupling elements 15 are provided in extending portions 16 of the support layer which extend beyond side edges 17 of the decorative layer. Said first coupling elements 15 extend substantially along the whole side edge 5 of the roof tile 1. In the example both the side edges 4 and 5 of the roof tile are provided with said first coupling elements 15.

FIG. 1 further shows that the roof tile 1 comprises a second coupling element 18 that is provided in the upper surface 9 of the decorative layer 6. In the example said second coupling element 18 is parallel to the upper edge 14 of the decorative layer 6 and runs substantially along the entire length of the decorative layer 6 itself. The second coupling element 18 is disposed at a distance from the upper edge 2 of the roof tile, that is less than one fourth of the width W of the roof tile 1. The roof tile 1 comprise also a further second coupling element 19 which is provided in the upper surface 9 of the decorative layer 6 and that is disposed parallel to the side edges 4-5 of the roof tile. Preferably, the further second coupling element 19 runs substantially from the upper edge 14 of the decorative layer 6 to the second coupling element 18. The further second coupling element is intended to be coupled with on first coupling element of an overlapping roof tile 1 when the roof tiles are disposed offset each other.

FIG. 2 shows, in an enlarged view, the section along plane II-II of FIG. 1.

As shown in FIG. 2, the decorative layer 6 comprises a glaze coating 20 of the ceramic body 8. The décor 10 is made in the glaze coating 20. The glaze coating 20 comprises a background glaze layer 21 of uniform color, which is situated below the printed décor 10, and a transparent or translucent glaze layer 2, which is arranged over said printed décor 10. It is noted that according to alternative examples the glaze coating 20 may be free from said transparent or translucent glaze layer 22 and/or from said printed décor 10.

The upper surface 9 of the decorative layer 6 is provided with a relief, which, in the represented example, is formed by a plurality of excavations 23 present in said upper surface 9. According to the present embodiment the relief is formed in the ceramic body 8 and manifest itself through the glaze coating 20, although according to non-showed embodiments the relief may be at least partially formed directly in the glaze coating 20.

The thickness T of the decorative layer 6 is less than 12 mm, for example less than 8 mm, more preferably less than 6 mm. The thickness T is greater than 1 mm, preferably greater than 3 mm.

The support layer 7 is in the form of a metal sheet 23. Preferably, the metal sheet (or plate) 23 is made of steel. The metal sheet 23 compresses the ceramic body 8 starting from the lower surface thereof. In this way, since the ceramic body 8 is in a compressive state, a major improvement in the impact resistance is obtained. In order to achieve this goal, the metal sheet 23 is firstly tensioned (stretched or elongated) by means of a mechanical or thermal stretching action and is then arranged underneath the ceramic body 8 while it is still in the elongated state. Then the stretched condition is released, by interrupting the mechanical stress or cooling the metal sheet 23, so as to cause compression of the ceramic body 8.

According to a first preferred embodiment, the metal sheet 23 has a thermal expansion coefficient greater than the thermal expansion coefficient of the ceramic body 8. Due to this solution the metal plate 22 may be stretched by means of heating so as to expand in a substantially uniform manner in every direction. After the metal sheet 23 has been arranged underneath the ceramic body 8 it may be cooled down so as to contract and cause compression of the ceramic body 8.

The metal sheet 23 has a thickness less than 1 mm, preferably less than 0.5 mm even more preferably less than 0.2 mm. The metal sheet 23 has a thickness A greater than 0.05 mm, preferably greater than 0.1 mm.

The metal plate 22 is attached to the lower surface of the ceramic body 8 by means of an adhesive. Said adhesive is preferably a reactive hotmelt polyurethane glue.

Preferably the metal sheet 23 is made in stainless steel, galvanized steel or comprises a coating that protects the sheet against corrosion.

As shown in FIG. 2, the first coupling elements 15 shows an upward concave shape, preferably a V-notch. The first coupling elements 15 on opposite side edges 4-5 have substantially the same shapes, preferably are substantially the same. Due to this shape the first locking elements 15 can perform a locking according to a downward movement.

FIG. 2 shows the most preferred configuration of the first preferred embodiment, wherein the first coupling elements 15 on opposite sides 4,5 of the roof tile 1 are slightly different, especially in dimension, to simplify coupling. In fact the coupling element 14 on the left side edge 4 of the roof tile shows a less deep concavity of the upward concave shape compared to the opposite first coupling element 15. Moreover, the first coupling element 15 on the right side edge 5 extends only partially beyond the edge 17 of the decorative layer 6, so that the said decorative layer 6 partially overlaps the upward concave shape.

In this way in a coupled condition, the decorative layers can be closer each other thereby reducing a gap between said decorative layers and improving waterproofness of the roof covering. In this way it is also possible that the portion of the lower surface of the decorative layer that partially overlap the coupling element, in the coupling condition, can form a locking surface that limit or prevent a mutual movement of the rooftile in a direction that is perpendicular to the plane of the roof covering.

FIG. 3 shows, in an enlarged view, the section along plane of FIG. 1.

As shown in FIG. 3, the roof tile comprises a third locking element 24 that is provided in the support layer 7 and that is disposed below the decorative layer 6. In particular, the third locking element 24 is disposed close to, preferably substantial in correspondence of, the lower edge 3 of the roof tile 1. The third coupling element 24 is adapted for being coupled in the second locking element 18 of an adjacent roof tile 1 that is partially overlapping the roof tile 1. The third locking element 24 has an upward concave shape to perform a locking in a downward movement.

The second locking element 28 is in form of an upwards concave groove open on the upper surface 9 of the decorative layer 6 to receive the third locking element 24 of an overlapping tile by a downward movement.

FIG. 3 further shows that the roof tile 1 comprises a supporting element 25 that is provided below the support layer 7. In the example the supporting element 25 is disposed below the decorative layer 6 so that it identifies the point of maximum thickness of the roof tile 1. In the example, the supporting element 25 is made directly in the support layer 7 by bending the metal sheet 23. It is noted that in alternative embodiment the supporting element 25 can be attached or fixed to the support layer 7. The supporting element 25 has the scope of supporting the roof tile 1 on the roof structure to adjust its inclination on the roof covering. In fact, because of overlapping between roof tiles 1, each tile will be slightly inclined with respect to the roof slope. Therefore, the supporting element 25 provides a support that improves strength of the tile against walking load.

FIG. 4 represents an enlarged view of detail F4 of FIG. 3, in an alternative of said first preferred embodiment of the invention wherein the support layer 7 is attached to the decorative layer 6 via a reinforcing element 26.

In this alternative, reinforcing element 26 comprises, preferably consists of, a resin material, for example a thermosetting resin or thermoplastic resin. Examples of thermosetting resin are epoxy, polyurethane, cyanoacrylate, unsaturated polyester, vinyl ester or acrylic resin. It is to be noted that in this example the reinforcing element 26 is constituted by the resin. Examples of thermoplastic resin are reactive hot melt, hot melt, polyester thermoplastic, vinyl etc. Preferably the resin is a rigid resin. In particular, according to a preferred embodiment of the invention the reinforcing element 26 comprises an epoxy resin. It is also preferred that the epoxy is a bicomponent resin, i.e., a thermosetting resin obtained by curing at low temperature (for example at room temperature) a mixture of two components, namely a resin and a hardener.

The resin preferably comprises a tensile strength between 50 and 90 MPa, more preferably between 60 and 80 MPa, for example 75 MPa. Moreover, the resin preferably comprises a compressive strength between 90 and 130 MPa, more preferably between 100 and 120 MPa, for example 110 MPa. It is also preferable that the resin shows a hardness value of at least 50 measured on a Shore D scale.

As illustrated the reinforcing element 26 covers the 100 percent of the lower surface of the ceramic body 8. The resin is preferably provided onto the lower surface of the ceramic body 8 in an amount greater than 150 g/sqm, more preferably greater than 200 g/sqm, for example 220 g/sqm.

As illustrated in FIG. 4 the ceramic body 8 comprises, at least in correspondence of its lower surface, an open porosity 7 adapted to be permeated by the resin of the reinforcing element 26.

Thus, according to this second embodiment of the invention, the ceramic body 8 comprises an apparent porosity between 0.1% and 10% determined according to ASTM C373, more preferably between 2% and 8%, for example 6%. Furthermore, the ceramic body 8 may preferably have a volume of the open pores 27 comprised between 0.01 cc (cubic centimeter) and 1 cc, more preferably between 0.10 cc and 0.90 cc, for example 0.60 cc.

Preferably, in order to properly flow into said open pores 27 the resin of the reinforcing element 26 comprises a viscosity at 20° C. less than 1000 mPas, preferably less than 800 mPas, more preferably less than 600 mPas, for example approximately 400 mPas. Within the scope of the invention "viscosity" means the viscosity of the uncured resin, for example the viscosity of the mixture of the two components before the completion of the curing, i.e., during the so-called pot life.

In an alternative of FIG. 4, said support layer 7 is made of one or more of the materials selected from the group consisting of: a thermoplastic polymer, such as polyvinylchloride, polyethylene, polypropylene and/or polyethylene terephthalate, a thermosetting polymer, such as polyurethane, and/or an elastomer, such as rubber or a thermoplastic elastomer.

In the alternative of FIG. 4, the support layer 7 is made of PVC, in particular rigid PVC. The support layer 7 may also comprise a high amount of filler materials, such as talc, limestone, chalk, e.g., more than 30 wt % or more than 60% wt Preferably the rigid PVC may comprise a flexural modulus between 1.5 and 3.5 GPa, for example, approximately 2.6 GPa. The support layer 30 may also comprise a flexural strength between 60 and 90 MPa, for example approximately 76 MPa.

In this alternative of a first preferred embodiment the support layer 7 can comprise a thickness less than 10 mm, even more preferably less than 4 mm.

In this alternative of a first preferred embodiment the resin of the reinforcing element 26 acts as an adhesive that bonds together the ceramic body 8 and the support layer 7.

The support layer 7 of this alternative of a first preferred embodiment can be made of cement-based board or mineral based board like magnesium oxide board. Moreover, the support layer 7 in the alternative can be a metal sheet as in the example of FIG. 2, wherein because of the presence of the reinforcing element 26, it is not necessary to compress the ceramic body 8.

FIG. 5 represents a cross-sectional side view of part of an installed roof covering 28 with roof tiles 1 according to FIG. 1.

The roof tiles 1 are attached or fastened to a framework (or roof structure) 29 by means of nails 30, which are put in the attachment holes 12.

The roof tiles 1 are installed in subsequent rows, of which only a few are represented in FIG. 5, namely the subsequent rows 31A-31B-31C. In particular, the roof tiles 1 are installed such that the roof tiles 1 of one row partially overlap the roof tiles 1 of a previous row. For example, the roof tiles 1 of row 31C and 31B respectively overlap the roof tiles 1 of previous row 31B and 31A respectively.

The overlap O between the roof tiles 1 of the respective rows is less than 50%, preferably less 35%. Or, in other words, the roof tiles 1 of row 31C and 31B respectively overlap the roof tiles 1 of previous row 31B and 31A, whereby the overlap O is such that less than 35% of the roof tiles 1 of row 31A and 31B is covered by the roof tiles 1 of row 31B and 31C respectively.

Due to the coupling elements 15, 18, 19, 24 the impermeability of the roof covering is improved so that it is not necessary to place any underlayment below the roof tiles 1, thereby accelerating the installation of the roof covering 28.

FIG. 6 represents a perspective view of a portion of a roof covering 28 according to the present invention, with a view on the front face of the roof tiles 1.

FIG. 6 shows that in the roof covering 28 the roof tile 1 on the same row 31A are coupled each other on the side edges 4-5 via the first coupling elements 15. The roof tile 1 of the overlapping row 31B are coupled to the roof tiles 1 of the row 31A, via the first coupling elements 15 coupled to the further second coupling elements 19, and the third coupling element 24 coupled to the second coupling element 18.

Said couplings are shown in FIGS. 7 and 8 showing enlarged views of sections along planes VII-VII and VIII-VIII respectively.

As shown in FIG. 7 the coupling between first coupling elements 15 of the two roof tiles 1 form first locking surfaces 32 that limit, preferably prevent, mutual movement of the roof tiles 1 in a direction substantially parallel to the plane of the roof covering 28, i.e. the slope of the roof, and substantially perpendicular to the side edges 4-5 of the roof tiles 1. As it is shown, since one first coupling element 15 is partially overlapped by the decorative layer 6 in this coupled condition is formed a second locking surface 33 that limit or prevent a mutual movement of the roof tiles 1 in a direction that is perpendicular to the plane of the roof covering 28.

FIG. 7 further shows that in the coupled condition of the roof tiles 1 in the same row 31A and intermediate space I is established between side edges 17 of the decorative layers 6. Preferably said intermediate space I is below 5 mm, more preferably below 3 mm so as to not be visible from the outside. As it is shown the fact that one first coupling element 15 is partially overlapped by the decorative layer 6 allows to reduce said intermediate space I and to improve waterproofness of the roof covering 28.

As shown in FIG. 7 the coupling between the first coupling elements 15 may provide for an improved impermeability of the roof covering 28 since there is no gap between the roof tiles 1 of the same row 31A. Due to the upward concave shape the first coupling elements 15 in the coupled condition may also form a draining channel for the draining of water to a gutter.

As shown in FIG. 8 the coupling between the third coupling element 24 of the roof tile on the upper row 31B and the second coupling element 18 of the roof tile 1 in the lower row 31A, allows for precisely determine the relative position of the roof tiles 1. In the coupled condition third locking surfaces 34 are formed between the coupling element that limit, preferably prevent, mutual movement of the roof tiles 1 in a direction substantially parallel to the plane of the roof covering 28, i.e., the slope of the roof, and substantially perpendicular to the upper and lower edges 2-3 of the roof tiles 1.

It is noted that the limitation of said movement is particularly useful during installation before the roof tiles 1 are nailed to the framework 29.

FIG. 9 shows the roof tile 1 according to a second preferred embodiment of the invention. The roof tile 1 in said second preferred embodiment differs from that shown in FIG. 1 in that the first coupling elements 15 are in the form of an adhesive strip 35 provided on the upper surface of the support layer 7 in correspondence of the extending portions 16 of the support layer 7 that extend beyond side edges 17 of the decorative layer 6. The adhesive strips 35 are configured to fix a lower surface of an adjacent roof tile, preferably the lower surface of the support layer 7 of an adjacent roof tile 1. In the example of FIG. 9 adhesive strips 35 are provided on both said extending portions 16 The roof tile 1 in this second preferred embodiment further differs from the embodiment of FIG. 1 in that it is free from attachment holes, in any case it is to be noted that also the first preferred embodiment can be free from attachment holes, as well as the second preferred embodiment roof tile 1 can comprise attachment holes 12.

FIG. 10 shows that preferably the adhesive strip 35 is covered by a peelable sheet 36 that ca be removed just before installation. The adhesive in the adhesive strip is preferably a pressure sensitive adhesive, for example natural rubber PSA, synthetic rubber PSA, acrylic PSA, silicone PSA, blends of different polymers etc.

FIG. 11 shows that in the second preferred embodiment, both the second coupling element and the third coupling element are absent. According to not shown alternatives of said second preferred embodiment, the roof tile 1 can comprise the second coupling element and the third coupling element which can be as described in FIG. from 1 to 8 or in form of adhesive strip as the first coupling elements 15.

FIGS. 12 and 13 shows an alternative of a second preferred embodiment wherein the support layer comprises only one extending portion 16 that extend beyond the side edge 17 of the decorative layer 6. This alternative is particularly preferred since the support layer 7 extends below substantially the entire lower surface of the decorative layer 6 thereby reinforcing the entire ceramic body 8, while at the same time it is possible to reduce the intermediate distance I between the side a 17 of the decorative layers 6 of two adjacent roof tiles.

In the second preferred embodiment of the invention illustrated in figures from 9 to 11 and its alternative illustrated in FIGS. 12 and 13, the support layer 7 can also be made according to the alternative of the first embodiment illustrated in figure, and can comprise the reinforcing element 26.

In FIG. 14 is illustrated a special embodiment of the invention. In this special embodiment, the support layer 7 comprises only one extending portion 16 that extend beyond the side edge 17 of the decorative layer 6. The first coupling element 15 is in form of the adhesive strip 35, it can be covered by the peelable sheet 36, and runs parallel to the side edge 17 of the decorative layer 6.

The roof tile 1 shown in FIG. 14 comprise an anchorage element 40 provided in said support layer 7. In a preferred configuration of the special embodiment illustrated in FIG. 14, the anchorage element 40 comprises an arm 41 whose longitudinal length extends substantially parallel to the side edge 17 of the decorative layer 6. The arm 41 comprises a first end 42 that is free and a second end 43 that is attached, better fixed, to the extending portion 16 of the support layer 7. The arm 41 can tilt around its second end 43 thereby adjusting its inclination relative to the plane of the roof tile 1, i.e., the plane of the support layer 7. In the example, the arm 41 is made in one piece with the support layer 7 and it can tilt due to the flexibility of the material in which the support layer is made. In some embodiments the arm can 41 be hinged to the support layer in other ways.

Instead of being tilted the anchoring element 40 can be deformable or configured in alternative ways so that the first end 42 of the arm 41 can be disposed on a plane that is different from the plane of the roof tile.

The anchorage element 40 comprises an attachment hole 12 having the same features described in relation to the previous figures. In the example, the attachment hole 12 is disposed on the arm 41 in a portion proximal to the first edge 42.

In the example, the anchoring element 40 is disposed beside the coupling element 15 so that the coupling element 15 itself is disposed between the anchoring element 40 and the edge 17 of the decorative layer 6.

Preferably the anchoring element 40 is disposed in closer to the lower edge of the roof tile 1 than to the upper edge, for example it occupies a part of the side edge of the roof tile 1 closer to the lower edge thereof.

FIG. 15 shows the support layer 7 without the decorative layer 6 on top. FIG. 15 shows that in this preferred configuration the support layer 7 is L shaped and cover less than the half of the lower surface of the decorative layer 6, preferably the areas around the upper and side edge of the decorative layer 6. This configuration is preferable to reduce the cost of the roof tile 1 in case it is intended to be installed in areas with low risk of hail, where impact resistance may not be a priority. In this example, the support layer 7 preferably comprises a metal sheet having the same features as described above in relation to other embodiments of the invention.

In FIG. 16 is shown a roof covering 28 formed with the roof tiles 1 of FIG. 14. In FIG. 16 it is shown that the anchoring element 40 helps in keeping the lower edge of the tile in the correct position so that water penetration in the roof covering is prevented.

FIG. 17 shows a preferred alternative of the roof tile 1 as illustrated in FIGS. from 14 to 16 wherein the length L is substantially equal to the width W. Preferably, the length L is comprised between 150 and 500 mm, more preferably between 200 and 400 mm, even more preferably between 250 mm and 350 mm.

It is to be noted that the drawings are merely schematic in order to better explain the invention and they are not drawn in scale.

Further, the present invention relates to one or more of the items as listed below, numbered from 1 to 61:

1. —Roof tile comprising a decorative layer, having at least a ceramic body, and a support layer disposed below the decorative layer, wherein the roof tile comprises an upper edge, a lower edge which is opposite to the upper edge and two opposite side edges, said side edges being transversal to the upper edge, wherein said roof tile comprises at least a first coupling element configured for being coupled to an adjacent roof tile in a roof covering and wherein said first coupling elements is provided at least at one side edge of the roof tile.

2. —The roof tile according to item 1, wherein said first coupling elements are at least partially formed in the support layer.

3. —The roof tile according to any of the preceding items, wherein the support layer comprises at least a portion extending beyond at least an edge of the decorative layer.

4. —The roof tile according to item 3, wherein said first coupling elements are at least partially formed in one or more of said extending portions.

5. —The roof tile according to any of the preceding items, wherein said first coupling elements are provided at opposite side edges, wherein said first coupling elements at opposite side edges have substantially the same shape, preferably are the same.

6. —The roof tile roof tile according to any of the preceding items, wherein said first coupling elements are configured to limit, preferably prevent, mutual movement between the roof tiles in a direction that is substantially parallel and/or perpendicular to the plane of the roof covering.

7. —The roof tile according to any of the preceding items, wherein said first coupling element is in form of an adhesive strip.

8. —The roof tile according to item 7, wherein said adhesive strip comprises a pressure sensitive adhesive.

9. —The roof tile according to item 7 or 8, wherein said adhesive strip comprise natural rubber PSA, synthetic rubber PSA, acrylic PSA, silicone PSA, blends of different polymers.

10. —The roof tile according to any of the items from 7 to 9, wherein said adhesive strip is covered by a peelable sheet.

11. —The roof tile according to any of the items from 1 to 6, wherein first coupling element is configured for forming a mechanical coupling with the coupling element of an adjacent roof tile.

12. —The roof tile according to any of the preceding items, wherein said first coupling elements comprise an upward concave shape.

13. —The roof tile according to any of the preceding items, wherein it comprises at least a second coupling element that is at least partially provided on, preferably formed in, the decorative layer 14. —The roof tile according to item 13, wherein the second coupling element in the decorative layer is at least partially provided on, preferably formed in, an upper surface of the decorative layer.

15. —Roof tile according to item 13 or 14, wherein said second coupling element is disposed at a predetermined distance from an upper edge of the decorative layer.

16. —Roof tile according to any of the items from 13 to 15, wherein said predetermined distance is less than ½ of the distance between the upper edge and the opposite lower edge, preferably less than ⅓.

17. —Roof tile according to any of the items from 13 to 16, wherein said second coupling element in the decorative layer is in form of a groove.

18. —Roof tile according to any of the items from 13 to 16, wherein said second coupling element is in form of an adhesive strip, preferably according to any of the items from 7 to 10.

19. —Roof tile according to item 17 or 18, wherein said groove or strip of the second coupling element runs parallel to an edge of the decorative layer.

20. —Roof tile according to any of the preceding items, wherein it comprises a third coupling element, preferably configured for coupling with the second coupling element according to any of the items from 13 to 19 of an adjacent roof tile in the roof covering.

21. —Roof tile according to item 20, wherein said third coupling element is provided in the support layer.

22. —Roof tile according to item 20 or 21, wherein said third coupling element is in the form of a downward projection that protrudes form a lower surface of the roof tile.

23. —The roof tile according to 20 to 21, wherein said first coupling element is in form of an adhesive strip, preferably according to any of the items from 7 to 10.

24. —The roof tile according to any of the preceding items, that comprises a supporting element that protrudes from the lower surface of the support layer, or that protrudes from the plane of the support layer.

25. —The roof tile according to item 24, wherein the supporting element is disposed closer to the upper edge of the roof tile than to the lower edge thereof.

26. —The roof tile according to item 24 or 25, wherein said supporting element is disposed below the decorative layer.

27. —The roof tile according to any of the item from 24 to 26, wherein the supporting element runs substantially along the entire length of the roof tile.

28. —The roof tile according to any of the preceding item, wherein the decorative layer is compressed by the support layer.

29. —The roof tile according to any of the preceding item, wherein the support layer comprises a metal sheet, preferably made of steel.

30. —The roof tile according to item 29, wherein the metal sheet shows a thickness less than 1 mm, preferably less than 0.7 mm even more preferably less than 0.5 mm; for example the metal sheet may have a thickness greater than 0.1 mm, preferably greater than 0.3 mm.

31. —The roof tile according to any of the preceding item, wherein the support layer is made of a thermoplastic material, preferably PVC or PP.

32. —The roof tile according to any of the preceding item, wherein the support layer comprises a filler, preferably a mineral filler.

33. —The roof tile according to any of the preceding items, wherein the support layer comprises a thickness less than 10 mm, even more preferably less than 4 mm.

34. —The roof tile according to any of the preceding items, wherein the support layer is attached to the decorative layer via a reinforcing element that preferably acts as the adhesive bonding together the decorative layer and the support layer.

35. —The roof tile according to item 34, wherein the reinforcing element comprises, preferably consist, of a resin, preferably permeating an open porosity of the ceramic body.

36. —The roof tile according to any of the preceding items, wherein the support layer comprises an extending portion that extends beyond an upper edge of the decorative layer.

37. —The roof tile according to any of the preceding items, comprising one or more attachment holes, preferably provided in the extending portion of item 36.

38. —The roof tile according item 37, wherein the attachment holes are aligned along the upper edge of the roof tile.

39. —The roof tile according to any of the preceding items, wherein the upper edge defines the length of the roof tile, preferably wherein the length is longer that the width.

40. —The roof tile according to any of the preceding items, wherein the decorative layer comprises a glaze coating of the ceramic body.

41. —The roof tile according to any of the preceding items, wherein the ceramic body is made of porcelain.

42. —The roof tile according to any of the preceding items, wherein the decorative layer comprises a décor, preferably a digitally printed décor.

43. —The roof tile according to item 42, wherein said décor imitates a plurality of roof tiles.

44. —A roof covering comprising a plurality of roof tiles according to the preceding items.

45. —A roof tile comprising a decorative layer, having at least a ceramic body, and a support layer disposed below the decorative layer, wherein the roof tile comprises an upper edge, a lower edge which is opposite to the upper edge and two opposite side edges, said side edges being transversal to the upper edge, wherein said roof tile comprises at least one anchoring element for anchoring the roof tile to a structure or framework.

46. —Roof tile in accordance with item 45, wherein the anchoring element comprises an attachment hole or is suitable to be perforated by an attachment element like a nail or a screw.

47. —Roof tile in accordance with item 45 or 46, wherein the anchoring element comprises a tilting arm that is able to tilt around one of its ends in order to adjust its inclination relative to the plane of the roof tile.

48. —Roof tile in accordance with any of the items from 45 to 47, wherein the roof tile comprises a support layer and that the anchoring element is provided in or on said support layer.

49. —Roof tile in accordance with item 48, wherein the support layer comprises at least a portion extending beyond at least an edge of the decorative layer.

50. —Roof tile in accordance with any of the items from 45 to 49, wherein said roof tile comprises at least a first coupling element configured for being coupled to an adjacent roof tile in a roof covering.

51. —Roof tile in accordance with item 50, wherein said first coupling elements is provided at least at one side edge of the roof tile.

52. —Roof tile in accordance with item 50 or 51, wherein said first coupling element is in form of an adhesive strip.

53. —Roof tile in accordance with item 52, wherein said adhesive strip comprises a pressure sensitive adhesive.

54. —Roof tile in accordance with item 52 or 53, wherein said adhesive strip comprise natural rubber PSA, synthetic rubber PSA, acrylic PSA, silicone PSA, blends of different polymers.

55. —Roof tile in accordance with any of the items from 52 to 54, wherein said adhesive strip is covered by a peelable sheet.

56. —Roof tile in accordance with any of the items from 50 to 55, wherein said first coupling element is disposed between an edge of the decorative layer and said anchoring element.

57. —A roof tile that comprises:

a decorative layer, having at least a ceramic body, and a support layer disposed below the decorative layer, wherein the roof tile comprises an upper edge, a lower edge which is opposite to the upper edge and two opposite side edges, said side edges being transversal to the upper edge;

a first coupling element configured for being coupled to an adjacent roof tile in a roof covering and wherein said first coupling element is provided at least at one side edge of the roof tile, preferably said first coupling element can be in form of an adhesive strip;

an anchoring element for anchoring the roof tile to a structure or framework, preferably said anchoring element can be disposed in a position that is proximal to said first coupling element, more preferably said coupling element being disposed between a side edge of the decorative layer and the anchoring element.

58. —Roof tile in accordance with item 57, wherein the roof tile comprises a support layer disposed below the decorative layer, preferably said support layer comprising at least an extending portion that extends beyond one of the edges of the decorative layer, preferably one of the side edges.

59. —Roof tile in accordance with item 58, wherein said first coupling element and said anchoring element are provided in or on said support layer, preferably in or on said extending portion.

60. —Roof tile in accordance with item 58 or 59, wherein it comprises one or more attachment holes, preferably provided in the support layer, in particular in an extending portion thereof that extends beyond the upper edge of the decorative layer.

61. —A roof tile in accordance with any of the items from 58 to 50, wherein said support layer is "L" shaped.

What is claimed is:

1. A roof tile comprising:

a decorative layer comprising at least a ceramic body;

a support layer disposed below the decorative layer;

an upper edge;

a lower edge which is opposite to the upper edge;

two opposite side edges, the side edges being transverse to the upper edge; and at least one anchoring element for anchoring the roof tile to a structure or framework, wherein the anchoring element comprises a tilting arm that is able to tilt around one of its ends in order to adjust its inclination relative to the plane of the roof tile.

2. The roof tile according to claim 1, wherein the anchoring element comprises an attachment hole or is suitable to be perforated by an attachment element like a nail or a screw.

3. The roof tile according to claim 1, wherein the anchoring element is provided in or on the support layer.

4. The roof tile according to claim 3, wherein the support layer comprises at least a portion extending beyond at least an edge of the decorative layer.

5. The roof tile according to claim 1 further comprising at least a first coupling element configured for being coupled to an adjacent roof tile in a roof covering.

6. The roof tile according to claim 5, wherein the first coupling elements is provided at least at one side edge of the roof tile.

7. The roof tile according to claim 5, wherein the first coupling element is in form of an adhesive strip.

8. The roof tile according to claim 7, wherein the adhesive strip comprises a pressure sensitive adhesive.

9. The roof tile according to claim 7, wherein the adhesive strip is covered by a peelable sheet.

10. The roof tile according to claim 5, wherein the first coupling element is disposed between an edge of the decorative layer and the anchoring element.

11. A roof tile comprising:

a decorative layer comprising at least a ceramic body;

a support layer disposed below the decorative layer;

an upper edge;

a lower edge which is opposite to the upper edge;

two opposite side edges, the side edges being transverse to the upper edge;

a first coupling element configured for being coupled to an adjacent roof tile in a roof covering, the first coupling element being provided at least at one side edge of the roof tile; and an anchoring element for anchoring the roof tile to a structure or framework, wherein said anchoring element is disposed in a position that is proximal to the first coupling element, and wherein the anchoring element comprises a tilting arm that is able to tilt around one of its ends in order to adjust its inclination relative to the plane of the roof tile.

12. The roof tile according to claim 11, wherein the support layer comprises at least an extending portion that extends beyond one of the edges of the decorative layer, preferably one of the side edges.

13. The roof tile according to claim 12 further comprising one or more attachment holes, provided in the support layer.

14. The roof tile according to claim 13, wherein the one or more attachment holes are provided in an extending portion of the support layer that extends beyond the upper edge of the decorative layer.

15. The roof tile according to claim 12, wherein the support layer is "L" shaped.

16. The roof tile according to claim 11, wherein the first coupling element and the anchoring element are provided in or on the support layer.

17. The roof tile according to claim 11, wherein the first coupling element is in the form of an adhesive strip.

18. The roof tile according to claim 11, wherein the coupling element is disposed between a side edge of the decorative layer and the anchoring element.

* * * * *